US012529171B2

(12) United States Patent
Lonati et al.

(10) Patent No.: US 12,529,171 B2
(45) Date of Patent: Jan. 20, 2026

(54) PROCESS FOR MANUFACTURING A TEXTILE ITEM BY MEANS OF A CIRCULAR WEFT KNITTING MACHINE, AND TEXTILE ITEM REALIZED BY MEANS OF THIS PROCESS

(71) Applicant: SANTONI S.P.A., Brescia (IT)

(72) Inventors: Andrea Lonati, Brescia (IT); Lionello Spada, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 18/841,253

(22) PCT Filed: Feb. 8, 2023

(86) PCT No.: PCT/IB2023/051121
§ 371 (c)(1),
(2) Date: Aug. 23, 2024

(87) PCT Pub. No.: WO2023/161752
PCT Pub. Date: Aug. 31, 2023

(65) Prior Publication Data

US 2025/0163616 A1 May 22, 2025

(30) Foreign Application Priority Data

Feb. 24, 2022 (IT) ..... 102022000003518

(51) Int. Cl.
*D04B 1/10* (2006.01)
*D04B 15/06* (2006.01)
(Continued)

(52) U.S. Cl.
CPC ..... *D04B 1/102* (2013.01); *D04B 15/06* (2013.01); *D04B 15/10* (2013.01); *D04B 15/78* (2013.01)

(58) Field of Classification Search
CPC . D04B 1/02; D04B 1/10; D04B 1/102; D04B 1/108; D04B 1/26; D04B 15/06; D04B 15/10
See application file for complete search history.

(56) References Cited

U.S. PATENT DOCUMENTS 4,926,660 A 5/1990 Takashi
12,193,521 B2 * 1/2025 Gladish ..... A61F 2/7812
(Continued)

FOREIGN PATENT DOCUMENTS

CN 113463257 A 10/2021
KR 100688345 B1 2/2007
(Continued)

OTHER PUBLICATIONS

International Search Report and Written Opinion dated Mar. 27, 2023 in corresponding International Application No. PCT/IB2023/051121, 12 pages.

*Primary Examiner* — Danny Worrell
(74) *Attorney, Agent, or Firm* — MH2 TECHNOLOGY LAW GROUP LLP

(57) ABSTRACT

A process for manufacturing a textile item by means of a circular weft knitting machine, of seamless type and provided at least with a feed, a needle-bearing organ supporting a plurality of needles, and a plurality of knockover sinkers, provides the programming of the knitting machine so as to define a textile item consisting of a plurality of successive stitch rows (R) of knitted fabric in succession, and to produce weft knitted fabric for manufacturing the textile item, according to the programming step. In the programming step is set at least a designed motif, defined on at least two successive stitch rows, i.e. following one another, in which in at least one of the two successive rows a portion of terrycloth knitted fabric(S) is present. The designed motif is defined on a plurality of consecutive rows and consists of a
(Continued)

serial repetition, for a certain number of times more than 1, of the two successive stitch rows, so as to obtain a structure with alternating rows, consisting of an alternating sequence of first rows and second rows of the two successive rows.

20 Claims, 10 Drawing Sheets

(51) Int. Cl.
*D04B 15/10* (2006.01)
*D04B 15/78* (2006.01)

(56) References Cited

U.S. PATENT DOCUMENTS

| | | | | |
|---|---|---|---|---|
| 12,262,758 | B2 * | 4/2025 | Murrietta | D04B 1/106 |
| 2013/0205839 | A1 | 8/2013 | Fukui | |
| 2016/0067108 | A1 | 3/2016 | Kawagoe et al. | |
| 2022/0205151 | A1 * | 6/2022 | Morgan | D04B 1/18 |

FOREIGN PATENT DOCUMENTS

| | | | |
|---|---|---|---|
| WO | 2022146573 | A1 | 7/2022 |
| WO | 2022146574 | A1 | 7/2022 |
| WO | 2022146575 | A1 | 7/2022 |

* cited by examiner

PROCESS FOR MANUFACTURING A TEXTILE ITEM BY MEANS OF A CIRCULAR WEFT KNITTING MACHINE, AND TEXTILE ITEM REALIZED BY MEANS OF THIS PROCESS

CROSS-REFERENCE TO RELATED APPLICATIONS

This application is a U.S. National Stage application of PCT/IB2023/051121, filed Feb. 8, 2023, pending, which claims priority to Italian Patent Application No. 102022000003518, filed Feb. 24, 2022, the disclosures of which are hereby incorporated by reference in their entireties.

FIELD OF THE INVENTION

The present invention has as object a process for manufacturing a textile item by means of a circular weft knitting machine. The present invention has also as object a textile item obtained by means of that process. In particular, the present invention is related to a textile process which provides for a combination of textile processing on successive rows, in particular a combination of portions and areas of terrycloth knitted fabric and/or floated knitted fabric, manufactured on a weft knitting machine and of seamless type.

BACKGROUND OF THE INVENTION

It is known the use of circular knitting machines for knitwear for the production of textile items of various types, destined to the manufacturing of garments and textile products of all types. Such textile items may constitute garments and products that are substantially already completed once manufactured by the knitting machine, or they may undergo subsequent operations and processing, such as cutting, stitching, applying additional portions, wrapping, etc.

Circular knitting machines for knitwear for the manufacturing of textile items comprise at least a needle-bearing organ (needle-bearing cylinder and/or plate), on which one or more series of needles is/are arranged along a circular path (circular needle beds), and devices designed to control the movement of the needles for the formation of the fabric. Knockover sinkers are arranged in radial seats obtained in an annular body (sinkers crown) arranged around the needle-holder cylinder, and said sinkers cooperate with the needles to form the knitted fabric.

In the manufacturing of textile items on circular knitting machines for knitwear, it is also known the use of various processing techniques that allow to manufacture different types of knitted fabric. For example, the processing may provide for knitting portions manufactured according to the following technical ways: unloaded needle (plain knitted loop), non-operating needle (bridle), withdrawn needle (tuck stitch).

Circular knitting machines for knitwear of seamless type are shown, for example, in WO2011042299 and WO2012117352 in the name of the same Applicant.

SUMMARY

In the context of manufacturing of textile items by means of circular knitting machines for knitwear of seamless type, the Applicant has encountered the presence of some limitations and drawbacks.

First, the Applicant noted that processes of known type allow limited combinations in the obtainable knitted fabric structures, and therefore do not always allow to manufacture textile items that have the necessary desired technical and/or aesthetic characteristics. For example, the patterns and motifs obtainable are limited, and the aesthetic effect achievable on the textile item may not be satisfactory.

The Applicant has also observed that the textile items obtained with the known processes have a quality-under the esthetical and/or technical profile—not always responding to the market needs.

Furthermore, the Applicant has observed that the processes of known type do not provide for the necessary versatility in terms of combinations of knitted fabric structures obtainable on a single textile item.

In this situation, an object at the basis of the present invention, in its various aspects and/or embodiments, is to propose a process for manufacturing a textile item with a circular knitting machine of seamless type, and a textile item obtained by means of tale process, that are able to solve the above issues and overcome the limitations of the known technique.

In particular, it is an object of the present invention to propose a process for manufacturing a textile item with specific structural characteristics able to confer determined technical properties to the item itself.

Another object of the present invention is to propose a process that allows to manufacture a textile item with specific esthetical characteristics and/or of comfort and fit.

Another object of the present invention is to propose a process that allows to manufacture a textile item characterized by a stable structure and not subject to defects or imperfections.

It is also object of the present invention to propose a process that allows to manufacture textile items in an economically competitive way.

Another object of the present invention is to propose a process able to provide the necessary versatility in terms of combinations of knitted fabric structures obtainable on a single textile item.

Another object of the present invention is to propose a process that allows to manufacture patterns and motifs, also complex and detailed, on a single textile item.

Another object of the present invention is to propose a process that allows to obtain specific esthetical effects on a single textile item.

It is also object of the present invention to propose a textile item manufactured on a circular machine for knitwear of seamless type wherein areas with different properties (both technical and esthetical) are all of them present and arranged where it is needed.

Another object of the present invention is to create alternating solutions, with respect to the known technique, in the manufacturing of knitted fabric textile items, and/or to open new pattern fields.

These objects, and any others, that will result better during the following description, are substantially reached by a process for manufacturing a textile item, and by a related textile item manufactured on a circular machine for knitwear of seamless type, according to one or more of the attached claims, as well as according to the following aspects and/or embodiments, variously combined, possibly including the aforesaid claims.

In a first aspect, the invention refers to a process for manufacturing a textile item by means of a circular knitting machine.

Preferably the process operates with a circular weft knitting machine.

Preferably the process operates with a circular knitting machine of seamless type.

In an aspect the process comprises the step of arranging a circular knitting machine comprising at least a feed or fall and a needle-bearing organ supporting a plurality of needles, defining a circular needle bed, which can be operated to pick up the threads dispensed by said at least one feed and to form weft knitted fabric; said needle-bearing organ being rotatable relative to said feed and said feed being arranged in proximity to said needle-bearing organ.

In an aspect the circular knitting machine comprises a plurality of sinkers, eventually also of special type, of knockover type, operatively associated to said plurality di needles.

In an aspect the process comprises the programming step of said knitting machine so as to define a textile item to be manufactured, said textile item consisting of a plurality of successive stitch rows.

In an aspect the process comprises the step of producing weft knitted fabric with said circular knitting machine so as to manufacture said textile item, according with the aforesaid programming step.

In an aspect, in said programming step is set at least a designed motif, defined on at least two successive stitch rows, i.e. following one another, in which:

- in at least one of the two successive rows a portion of terrycloth knitted fabric is present;
- in at least one of the two successive rows a portion of floated knitted fabric is present.

In an aspect, in said step of arranging a circular knitting machine, the circular knitting machine is structured so as to enable a needle-needle selection, i.e. it is structured so as to individually select any desired needle and activate the respective sinker, so as to allow the execution of special stitches in certain desired positions only.

In an aspect, in the context of said needle-needle selection performed by the knitting machine, the execution of special stitches in certain desired positions only takes place in particular thanks to the needle-sinker interaction, i.e. thanks to the interaction between each needle, which can be individually selected at will, and the respective sinker. In this case, each sinker can be individually activated by a direct or indirect action of the respective needle when the latter is selected.

In an aspect, said portion of floated knitted fabric is strictly manufactured on a first row of said two successive rows and said portion of terrycloth knitted fabric is strictly manufactured on a second row of said two successive rows, or vice versa.

In an aspect, said portion of floated knitted fabric is combined, on at least a same row of said two successive rows, with said portion of terrycloth knitted fabric.

In an aspect, are defined:

- a portion of terrycloth knitted fabric and a portion of floated knitted fabric combined on the first row of said two successive rows;
- a respective portion of terrycloth knitted fabric and a respective portion of floated knitted fabric combined on the second row of said two successive rows.

In an aspect, the first and the second row of the two successive rows are homogeneous with one another and exhibit the same combinations of knitted structures, i.e. they exhibit the same knitted structures in suitable positions so as to obtain the motif/pattern to be made.

In an aspect, the programming of the knitting machine includes a continuous succession of the same row, where each row exhibits the same types of knitted fabric in corresponding positions.

In an aspect, on the row-of said two successive rows—in which said portion of floated knitted fabric is present, and vice versa on the row, of said two successive rows, in which said portion of terrycloth knitted fabric is present, said portion of floated knitted fabric is not present.

In an aspect at least one of said two successive rows exhibits, at the same time inside thereto, the portion of terrycloth knitted fabric and at least one portion of knitted fabric manufactured according to one or more of the following techniques:

unloaded needle (plain knitted loop);
non-operating needle (float);
withdrawn needle (tuck stitch).

In an aspect at least one of said two successive rows exhibits, at the same time inside thereto, the portion of floated knitted fabric (F) and at least one portion of knitted fabric manufactured according to one or more of the following techniques:

unloaded needle;
non-operating needle;
withdrawn needle.

In an aspect at least one of said two successive rows exhibits, at the same time inside thereto, the portion of terrycloth knitted fabric, the portion of floated knitted fabric and at least one portion of knitted fabric manufactured according to one or more of the following techniques:

unloaded needle;
non-operating needle;
withdrawn needle.

In an aspect at least one of said two successive rows exhibits, at the same time inside thereto, the portion of terrycloth knitted fabric, the portion of floated knitted fabric and at least one portion of knitted fabric manufactured with a portion of thread with a different color or with a portion of thread differing from the threads used in the basic knitted structure.

In an aspect said programming step includes defining, in said two successive stitch rows:

- a portion of terrycloth knitted fabric and a portion of plain knitted fabric, combined on the first row of said two successive rows;
- a portion plain knitted fabric and a portion of floated knitted fabric, combined on the second row of said two successive rows.

In an aspect at least one of said two successive rows exhibits a portion of floated knitted fabric between two portions of terrycloth knitted fabric placed on the sides (i.e. before and after) of said portion of floated knitted fabric along the development of the row.

In an aspect, along the development (i.e. along the diameter of the tubular) of at least one of said two successive rows, or in both rows, is repeated several times:

- an alternating sequence of a portion of floated knitted fabric and a portion of terrycloth knitted fabric; and/or
- an alternating sequence of a portion of terrycloth knitted fabric and a portion of plain knitted fabric; and/or
- an alternating sequence of a portion of floated knitted fabric and a portion of plain knitted fabric.

In an aspect said designed motif, set in said programming step, is defined on a plurality of consecutive rows and consists of a serial repetition—for a certain number of times (preferably more than 1)—of said two successive stitch rows, so as to obtain a structure with alternating rows, consisting of an alternating sequence of first rows and second rows of said two successive rows.

In an aspect said structure with alternating rows consists of an alternating sequence of:

first rows comprising at least one portion of floated knitted fabric and at least one portion of terrycloth knitted fabric;

second rows comprising at least one portion of floated knitted fabric and a portion of knitted fabric obtained with unloaded or non-operating needles.

In an aspect, in said structure with alternating rows the two successive rows are different rows, i.e. they exhibit differentiated knitted structures in adjacent/analogous positions.

In an aspect, said structure with alternating rows provides that the two successive rows, different from one another as far as stitch type is concerned, are repeated during the knitting.

In an aspect said designed motif, set in said programming step, is defined so as to exhibit different knitted structures, among which one or more portions of:

floated knitted fabric, knitted fabric obtained with unloaded, non-operating and/or withdrawn needles, knitted fabric obtained with a thread with a different color, inside an area of at least two consecutive rows of which at least one has an area of terrycloth knitted fabric.

In an aspect said designed motif, set in said programming step, exhibits a portion of floated knitted fabric between portions of terrycloth knitted fabric and is defined on a succession of first and second alternating rows, where:

on the first row floated knitted fabric combined with knitted fabric obtained with unloaded, non-operating and/or withdrawn needles, is present;

on the second row terrycloth knitted fabric combined with knitted fabric obtained with unloaded, non-operating and/or withdrawn needles, is present.

In an aspect, wherein in case a same row exhibits a portion of floated knitted fabric combined with a portion of terrycloth knitted fabric, between these two portions a portion of plain knitted fabric (or other non-floated knitted fabric), is present, placed between and separating the floated knitted fabric and the terrycloth knitted fabric.

In an aspect, the programming step includes a direct passage from a portion of floated knitted fabric to a portion of terrycloth knitted fabric only in case the floated knitted fabric and the terrycloth knitted fabric are defined in corresponding portions but on alternating rows.

In an independent aspect thereof, the present invention refers to a textile item manufactured by means a circular weft knitting machine, of seamless type, and composed by a plurality of successive stitch rows; the textile item comprising at least one designed motif, defined on at least two successive stitch rows, i.e. following one another, in which:

in at least one of the two successive rows a portion of terrycloth knitted fabric is present;

in at least one of the two successive rows a portion of floated knitted fabric is present.

In an aspect, in the textile item said portion of floated knitted fabric is strictly manufactured on a first row of said two successive rows and said portion of terrycloth knitted fabric is strictly manufactured on a second row of said two successive rows, or vice versa.

In an aspect, in the textile item said portion of floated knitted fabric is combined, on at least the same row of said two successive rows, with said portion of terrycloth knitted fabric.

In an aspect, in the textile item are defined:

a portion of terrycloth knitted fabric and a portion of floated knitted fabric, combined on the first row of said two successive rows;

a respective portion of terrycloth knitted fabric and a respective portion of floated knitted fabric, combined on the second row of said two successive rows.

In an aspect, in the textile item the designed motif is defined on a plurality of consecutive rows and consists of a serial repetition, for a certain number of times (preferably more than 1)—of said two successive stitch rows, so as to obtain a structure with alternating rows, consisting of an alternating sequence of first rows and second rows of said two successive rows.

In an independent aspect thereof, the present invention refers to a process for manufacturing a textile item by means of the aforesaid circular weft knitting machine, preferably of seamless type.

In an aspect the process comprises the programming step of said knitting machine so as to define a textile item to be manufactured, said textile item consisting of a plurality of successive stitch rows.

In an aspect the process comprises the step of producing weft knitted fabric with said circular knitting machine so as to manufacture said textile item, according with the aforesaid programming step.

In an aspect, in said programming step is set at least a designed motif, defined on at least two successive stitch rows, i.e. following one another, in which in at least one of the two successive rows a portion of terrycloth knitted fabric is present.

In an aspect, said designed motif, set in said programming step, is defined on a plurality of consecutive rows and consists of a serial repetition—for a certain number of times, preferably more than 1—of said two successive stitch rows, so as to obtain a structure with alternating rows, consisting of an alternating sequence of first rows and second rows of said two successive rows.

In an aspect the process provides that the two rows (equal or alternating) are repeated for a determined number of times.

In an aspect, said portion of terrycloth knitted fabric is strictly manufactured on a first row of said two successive rows whereas the second row of said two successive rows do not exhibit portions of terrycloth knitted fabric, or vice versa. In this case on the two successive rows it is present the terrycloth knitted fabric on only a row, then the schema results terrycloth knitted fabric for a row yes and a row not (terrycloth knitted fabric with alternating rows).

In an aspect:

on the first row of said two successive rows a portion of two successive is present;

on the second row of said two successive rows a respective portion of terrycloth knitted fabric is present.

In this case on both the two successive rows it is present the two successive (two successive on all the rows).

In an aspect said programming step provides to define, in said two successive stitch rows:

a portion of terrycloth knitted fabric on the first row of said two successive rows (eventually combined with a portion of plain knitted fabric);

plain knitted fabric on the second row of said two successive rows (without the presence of terrycloth knitted fabric). This embodiment provides the following schema: terrycloth knitted fabric for a row yes and a row not, with plain knitted fabric.

In an aspect said programming step provides to define, in said two successive stitch rows:

- a portion of terrycloth knitted fabric on the first row of said two successive rows (eventually combined with a portion of plain knitted fabric);
- knitted fabric manufactured with non-operating needles on the second row of said two successive rows (without the presence of terrycloth knitted fabric). This embodiment provides the following schema: terrycloth knitted fabric for a row yes and a row not, with non-operating needle.

In a possible embodiment, said programming step provides to define, in said two successive stitch rows:

- a portion of terrycloth knitted fabric on the first row of said two successive rows;
- knitted fabric manufactured with non-operating needles on the second row of said two successive rows and in a position corresponding to the one where it is present the terrycloth knitted fabric on the first row, or vice versa:
- a portion of terrycloth knitted fabric on the second row of said two successive rows;
- knitted fabric manufactured with non-operating needles on the first row of said two successive rows and in a position corresponding to the one where it is present the terrycloth knitted fabric on the second row.

Substantially, in this case it is manufactured the knitted fabric with non-operating needles only in the same are where it is present the terrycloth knitted fabric on the preceding or the following row.

In an aspect said programming step provides to define, in said two successive stitch rows:

- a portion of terrycloth knitted fabric and a portion of plain knitted fabric, combined on the first row of said two successive rows;
- a respective portion of terrycloth knitted fabric and a respective portion of plain knitted fabric combined on the second row of said two successive rows,
- wherein the portion of terrycloth knitted fabric on the first row and the respective portion of terrycloth knitted fabric on the second row are defined in positions substantially corresponding along the development of the fabric. This embodiment provides the following schema: terrycloth knitted fabric for every row, corresponding positions.

In an aspect said programming step provides to define, in said two successive stitch rows:

- a portion of terrycloth knitted fabric and a portion of plain knitted fabric combined on the first row of said two successive rows;
- a respective portion of plain knitted fabric and a respective portion of terrycloth knitted fabric combined on the second row of said two successive rows, wherein la portion of terrycloth knitted fabric on the first row and the respective portion of terrycloth knitted fabric on the second row are defined in the reverse sided positions along the development of the fabric. This embodiment provides the following schema: terrycloth knitted fabric for every row, the reverse sided positions.

In an aspect, the first and the second row of the two successive rows are homogeneous with one another and exhibit the same combinations of knitted structures, i.e. they exhibit the same knitted structures in suitable positions so as to obtain the motif/pattern to be made.

In an aspect, the programming of the knitting machine includes a continuous succession of the same row, where each row exhibits the same types of knitted fabric in corresponding positions.

In an independent aspect thereof, the present invention refers to a textile item manufactured by means of a circular weft knitting machine, of seamless type, and consists of a plurality of successive stitch rows; the textile item comprising at least a designed motif, defined on at least two successive stitch rows, i.e. consecutive to each other, wherein in at least one of the two successive rows is present a portion of terrycloth knitted fabric. In an aspect, depending on the previous one, said designed motif is defined on a plurality of consecutive rows and consists of a serial repetition—for a certain number of times more than 1—of said two successive stitch rows, so as to obtain a structure with alternating rows, consisting of an alternating sequence of first rows and second rows of said two successive rows.

In an aspect, in the textile item said portion of terrycloth knitted fabric is strictly manufactured on a first row of said two successive rows whereas the second row of said two successive rows does not exhibit portions of terrycloth knitted fabric, or vice versa.

In an aspect, in the textile item:

- on the first row of said two successive rows is present a portion of terrycloth knitted fabric;
- on the second row of said two successive rows is present a respective portion of terrycloth knitted fabric.

In an aspect, in said two successive stitch rows are defined:

- a portion of terrycloth knitted fabric on the first row of said two successive rows (eventually combined with a portion of plain knitted fabric);
- plain knitted fabric on the second row of said two successive rows (without the presence of terrycloth knitted fabric).

In an aspect, in said two successive stitch rows are defined:

- a portion of terrycloth knitted fabric on the first row of said two successive rows (eventually combined with a portion of plain knitted fabric);
- plain knitted fabric manufactured with non-operating needles on the second row of said two successive rows (without the presence of terrycloth knitted fabric).

In the previous aspects as well as in the following detailed description and the attached claims, each of the technical characteristics introduced with reference to the process for manufacturing a textile item, and in particular each of the characteristics related to the knitted fabric structures, is analogously applicable also to the textile item considered per se, i.e. as product manufactured by means of a processing made by a circular knitting machine for knitwear.

Other characteristics and advantages will result more from the detailed description of a preferred, but non-exclusive, embodiment of a process for manufacturing a textile item and of a textile item realized on a circular machine for knitwear of seamless type, according to the present invention.

DESCRIPTION OF FIGURES

This description will be illustrated below with reference to the attached figures, provided for illustrative purposes only and, therefore, non-limiting thereto, in which.

Figure 1:
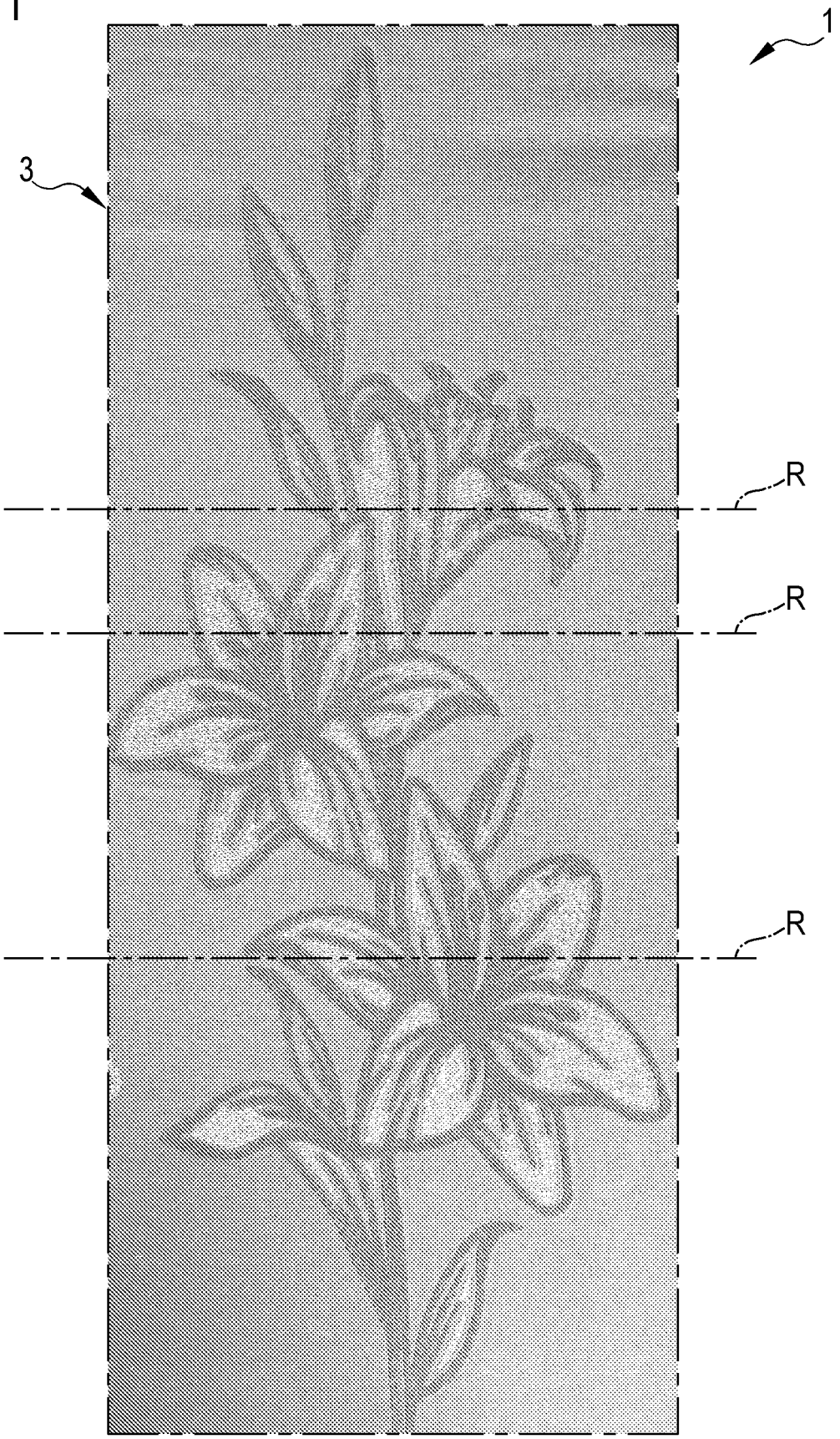
FIG. 1 shows a first embodiment, of exemplary type, of a textile item manufactured by means of the process according to the present invention; in particular, is shown the "reverse side" of the textile item, i.e. the internal side of the tubular fabric as it is manufactured by the circular knitting machine.

It is to be noted that the united figures consist, in particular, of actual pictures depicting real examples of textile items (according to various and different exemplary embodiments) manufactured by means of the process according to the present invention.

DETAILED DESCRIPTION

With reference to the above-mentioned figures, a textile item manufactured with a process according to the present invention has been globally indicated by the number 1.

For the execution of the process according to the present invention, it can be used (preferably but non exclusively) a weft knitting machine with at least a feed or fall and with a needle-bearing organ supporting a plurality of needles-defining a circular needle bed-which can be operated, in a way per se known, to pick up the threads dispensed by said at least one feed and to form weft knitted fabric. The needle-bearing organ is rotatable relative to said feed and the feed is arranged in proximity to the needle-bearing organ.

The circular knitting machine for the execution of the process according to the present invention is a circular weft knitting machine, and of the seamless type.

From a textile technology point of view, the structure of the whole knitting machine and the functioning of the needle-bearing organ (for example the cooperation between needles and threads, etc.) are not described in detail, being known in the technical field of the present invention.

According to a first embodiment, the process according to the present invention provides first of all to arrange a circular weft knitting machine, and of seamless type, comprising:

- at least a feed or fall;
- needle-bearing organ supporting a plurality of needles, defining a circular needle bed, which can be operated to pick up the threads dispensed by said at least one feed and to form weft knitted fabric; the needle-bearing organ being rotatable relative to the feed and the feed is arranged in proximity to the needle-bearing organ;
- a plurality of knockover sinkers, in case also of a special type, operatively associated to the plurality of needles.

The process provides then for programming the knitting machine so as to define the textile item to be manufactured, which first of all consists of a plurality of successive stitch rows.

Once the textile item is defined, the process passes to the step of producing of the weft knitted fabric by means of the circular knitting machine, for manufacturing then the textile item according to the programming step.

The process provides that, in the step of defining of the textile item, is set at least a designed motif, that is defined on at least two successive stitch rows, i.e. following one another, in which:

in at least one of the two successive rows a portion of terrycloth knitted fabric is present;

in at least one of the two successive rows a portion of floated knitted fabric is present.

Substantially the aforesaid embodiment of the process implements the embodiment of "selectable" garments in terrycloth knitted fabric combined with floated knitted fabric, on a b or on both rows. As a matter of fact, it is to be observed that the terrycloth knitted fabric is present on at least one of the two successive rows such as the floated knitted fabric is present on at least one of the two successive rows: the row considered can be the same (obtaining the combination terrycloth-floated knitted fabric on a single row) or the terrycloth knitted fabric is on one of the two successive rows and the floated knitted fabric is on the other of the two successive rows (obtaining that the combination terrycloth-floated knitted fabric is anyhow present considering the two successive rows).

Examples of textile items manufactured according to this process are shown in FIGS. 1-7 and 10-16, that will be analyzed hereinafter.

Preferably, the circular knitting machine used for actuating this process is structured for allowing a needle-needle selection, i.e. is structured for individually allowing any desired needle and activating the respective sinker, for allowing executing special stitches (for example terrycloth knitted fabric) in certain desired positions only.

Preferably, in the context of the aforesaid needle-needle selection carried out by the knitting machine, the execution of special stitches in certain desired positions only takes place in particular thanks to the needle-sinker interaction, i.e. thanks to the interaction between each needle, which can be individually selected at will, and the respective sinker. In this case, each sinker can be individually activated by a direct or indirect action of the respective needle when the latter is selected. It is then a needle-needle selection (for each needle individually) that makes a sinker-sinker selection.

An example of embodiment of "needle-needle selection" in a circular knitting machine is described in the Italian patent application No. 102021000018047, in the name of the same Applicant, which is incorporated herein as reference.

The technical solution described in application No. 102021000018047, which allows the needle-needle selection, i.e., the individual selection of any needle at will and the activation of the respective sinker, by means of the needle-sinker interaction, can be used to implement the process according to the present invention, in its possible embodiments.

According to a possible embodiment, the portion of floated knitted fabric is strictly manufactured on a first row of the two successive rows and the portion of terrycloth knitted fabric is strictly manufactured on a second row of the two successive rows, or vice versa.

In this case, on the two successive rows there is the alternating presence of terrycloth knitted fabric and floated knitted fabric.

According to another embodiment, the portion of floated knitted fabric is combined, on at least a same row of the two successive rows, with the portion of terrycloth knitted fabric.

In this case, on at least one of the two rows are contemporarily present both the terrycloth knitted fabric and the floated knitted fabric. For "contemporarily present" is intended that the terrycloth knitted fabric and the floated knitted fabric are together on a same single row, but not necessarily proximal or adjacent.

According to another embodiment, are defined:

a portion of terrycloth knitted fabric and a portion of floated knitted fabric combined on the first row of the due successive rows;

a respective portion of terrycloth knitted fabric and a respective portion of floated knitted fabric combined on the second row of the two successive rows.

In this case, on both the two successive rows there is the simultaneous presence of the terrycloth knitted fabric and the floated knitted fabric. Substantially, the simultaneous presence of the terrycloth knitted fabric and the floated knitted fabric together on a same single row is repeated for both the successive rows. Also in this case, the simultaneous presence of the terrycloth knitted fabric and the floated knitted fabric both on the first and on the second row does not necessarily imply that the portions of terrycloth knitted fabric and floated knitted fabric proximal, adjacent or corresponding between the first and the second row.

Preferably, the first and the second row of the two successive rows can be homogeneous with one another and exhibit the same combinations of knitted structures, i.e. exhibit the same knitted structures in suitable positions so as to obtain the motif/pattern to be made. This means that there can be portions with the same knitted structure (terrycloth knitted fabric or floated knitted fabric) in nearby or corresponding (or even displaced) positions on successive rows according to the defined pattern. Obviously, by modifying the pattern we are going to change the positions of the various portions of the knitted fabric of different typology in the successive stitch rows.

In a possible embodiment, the programming of the knitting machine can provide a continuous succession of the same row, where each row exhibits the same types of knitted fabric in corresponding positions. In another embodiment, on the row-of the two successive rows—in which the portion of floated knitted fabric is present, and vice versa on the row, of the two successive rows, in which the portion of terrycloth knitted fabric is present, the portion of floated knitted fabric is not present.

In this case in the two successive stitch rows is present a precise alternating sequence of terrycloth knitted fabric without floated knitted fabric on a row and floated knitted fabric without terrycloth knitted fabric on the other row.

In a possible embodiment, at least one of the two successive rows exhibits, at the same time inside thereto, the portion of terrycloth knitted fabric and at least one portion of knitted fabric manufactured according to one or more of the following techniques:

unloaded needle (plain knitted loop);

non-operating needle (float);

withdrawn needle (tuck stitch).

This type of embodiment provides the combination of terrycloth knitted fabric and knitted fabric manufactured according to one or more of the techniques-typical of the circular knitting machines-on a same row.

In a possible embodiment, at least one of the two successive rows exhibits, at the same time inside thereto, the portion of floated knitted fabric and at least a portion of knitted fabric manufactured according to one or more of the following techniques:

unloaded needle;

non-operating needle;

withdrawn needle.

This type of embodiment provides the combination of floated knitted fabric and knitted fabric manufactured according to one or more of the techniques on a same row.

In a possible embodiment, at least one of the two successive rows exhibits, at the same time inside thereto, the portion of terrycloth knitted fabric, the portion of floated knitted fabric and at least a portion of knitted fabric manufactured according to one or more of the following techniques:

unloaded needle;

non-operating needle;

withdrawn needle.

This type of embodiment provides the combination-on a same row-of terrycloth knitted fabric, floated knitted fabric and knitted fabric manufactured according to one or more of the techniques.

In a possible embodiment, at least one of the two successive rows exhibits, at the same time inside thereto, the portion of terrycloth knitted fabric, the portion of floated knitted fabric and at least a portion of knitted fabric manufactured with a portion of thread with a different color or with a portion of thread differing from the threads used in the basic knitted structure.

In another embodiment, the programming step provides to define, in the two successive stitch rows:

a portion of terrycloth knitted fabric and a portion of plain knitted fabric combined on the first row of the two successive rows;

a portion of plain knitted fabric and a portion of floated knitted fabric combined on the second row of the two successive rows.

In another embodiment, at least one of the two successive rows exhibits a portion of floated knitted fabric between two portions of terrycloth knitted fabric placed on the sides (i.e. before and after) of portion of floated knitted fabric, along the development of the row.

In another embodiment, along the development (i.e. along the diameter of the tubular) of at least one of the two successive rows, or in both rows, is repeated several times:

an alternating sequence of a portion of floated knitted fabric and a portion of terrycloth knitted fabric; and/or an alternating sequence of a portion of terrycloth knitted fabric and a portion of plain knitted fabric; and/or an alternating sequence of a portion of floated knitted fabric and a portion of plain knitted fabric.

In another embodiment, the aforesaid designed motif, set in the programming step the knitting machine, is defined on a plurality of consecutive rows and consists of a serial repetition—for a certain number of times (preferably more than 1)—of said two successive stitch rows, so as to obtain a structure with "alternating rows", consisting of an alternating sequence of first rows and second rows of said two successive rows.

Preferably the aforesaid serial repetition takes place for a certain number of times more than 1 or more than 2, or for a multiplicity of times.

According to possible embodiment of the process, the structure "with alternating rows" consists of an alternating sequence of:

first rows comprising at least one portion of floated knitted fabric and at least one portion of terrycloth knitted fabric;

second rows comprising at least one portion of floated knitted fabric and a portion of knitted fabric obtained with unloaded or non-operating needles.

Preferably, in the structure with alternating rows the two successive rows are different rows, i.e. they exhibit differentiated knitted structures in adjacent/analogous positions.

Preferably, the structure with alternating rows provides that the two successive rows, different from one another as far as stitch type is concerned, are repeated during the knitting.

In another embodiment, the designed motif, set in the programming step the knitting machine, is defined so as to exhibit different knitted structures, among which one or more portions of:

floated knitted fabric, knitted fabric obtained with unloaded, non-operating and/or withdrawn needles, knitted fabric obtained with a thread with a different color, inside an area of at least two consecutive rows of which at least one has an area of terrycloth knitted fabric.

In another embodiment, the designed motif, set in the programming step the knitting machine, exhibits a portion of floated knitted fabric between portions of terrycloth knitted fabric and is defined on a succession of first and second alternating rows, where:

on the first row floated knitted fabric combined with knitted fabric obtained with unloaded, non-operating and/or withdrawn needles, is present;

on the second row terrycloth knitted fabric combined with knitted fabric obtained with unloaded, non-operating and/or withdrawn needles, is present.

Typically, wherein in case a same row exhibits a portion of floated knitted fabric combined with a portion of terrycloth knitted fabric, between these two portions a portion of plain knitted fabric (or other non-floated knitted fabric), is present, placed between and separating the floated knitted fabric and the terrycloth knitted fabric. In other words it is not present a direct passage, on a same row, from the floated knitted fabric to the terrycloth knitted fabric, but it is present a transition area (for example of some needles) in plain knitted fabric placed subsequently to floated knitted fabric and before passing to the terrycloth knitted fabric.

Preferably, the programming step the knitting machine provides to define a direct passage from a portion of floated knitted fabric to a portion of terrycloth knitted fabric only in case the floated knitted fabric and the terrycloth knitted fabric are defined in corresponding portions but on "alternating rows".

In another possible embodiment, the process of the present invention provides, in the programming step, to set at least a designed motif, defined on at least two successive stitch rows, i.e. consecutive to each other, wherein in at least one of the two successive rows is present a portion of terrycloth knitted fabric. Furthermore, the designed motif is defined on a plurality of consecutive rows and consists of a serial repetition—for a certain number of times more than 1—of the two successive stitch rows, so as to obtain a structure with alternating rows, consisting of an alternating sequence of first rows and second rows of said two successive rows. Substantially this embodiment of the process implements the embodiment of garments with terrycloth knitted fabric "in selection", without combination with floated knitted fabric, where the terrycloth knitted fabric is on alternating rows or on both the rows.

Figure 8:
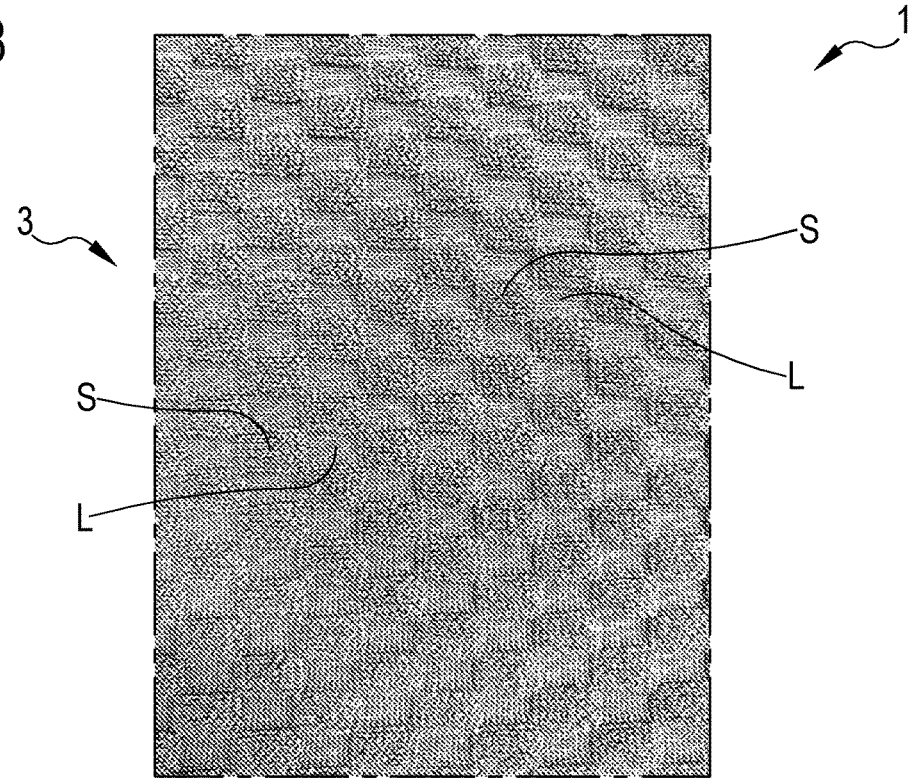
FIG. 8 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.

Examples of textile items manufactured according to this process are shown in FIG. 8 (terrycloth knitted fabric on both the rows), 9 (terrycloth knitted fabric on alternating rows) e 17 (terrycloth knitted fabric on both the rows), that will be analyzed hereinafter.

In the context of the present description and of the claims, for "portion" is intended as a series of successive knitting stitches forming part of a knitting row. Each knitting fabric "portion" affects a certain number of (contiguous) needles, i.e. is manufactured by a respective needle sector.

For "floated knitted fabric" in intended a knit made with two threads, of which one thread makes the basic knit while the other thread "floats" (i.e. is discarded/floated) on some needles.

Similarly, terrycloth knitted fabric provides the use of two threads, of which one thread makes the basic knit/tie while the other makes the typical terrycloth knitted fabric curl.

Described below, with reference to the attached FIGS. 1-17, are some actual embodiments, of an entirely exemplary and non-limiting type, of manufacturing of textile items according to the present invention.

These exemplary textile items (indicated in figures with the reference number 1) are manufactured preferably by means of the above-described process, in its different embodiments.

It should be noted that, in the description as well as in the attached claims, the shapes of the areas, portions, and patterns on the fabric of the textile item are referred to the arrangement of the fabric on a plane while, when the item is still placed on the machine, that surface is tubular.

First of all, as shown above, the process of the present invention allows to make all the typical knitting structures of seamless knitting machines (plain, withdrawn, discharged, floated, patterns) with the addition of being able to simultaneously make terrycloth knitted fabric in "needle-needle selection".

In particular, the terrycloth knitted fabric in selection can be of the "vanisis (or vanise) terrycloth knitted fabric" type, which requires for its embodiment to arrange specific sinkers appropriately profiled for that purpose. The peculiarities that characterize this typology of vanisis terrycloth knitted fabric are the following: it is a knitted structure where on the right side (external side of the knit) is visible the bottom thread (necessary for the tying of the terrycloth knitted fabric curl) while on the reverse side (internal side of the knit) is visible the thread of the terrycloth knitted fabric curl that remains precisely "in vanisis" (or vanisè) i.e. hidden under (or covered by) the bottom thread.

It should be noted that, by convention:

- the right side 2 of the knitted fabric is the external side of the fabric, i.e. the external side of the tubular fabric as it is manufactured by the circular knitting machine;
- the reverse side 3 of the knitted fabric is internal side of the fabric, i.e. the internal side of the tubular fabric as it is manufactured by the circular knitting machine.

The use of the sinker-sinker selection, after needle-needle selection, allow to make various textile combinations, on the same row of the knitted fabric, that allow to obtain different typologies of fabrics and textile items.

Figure 2:
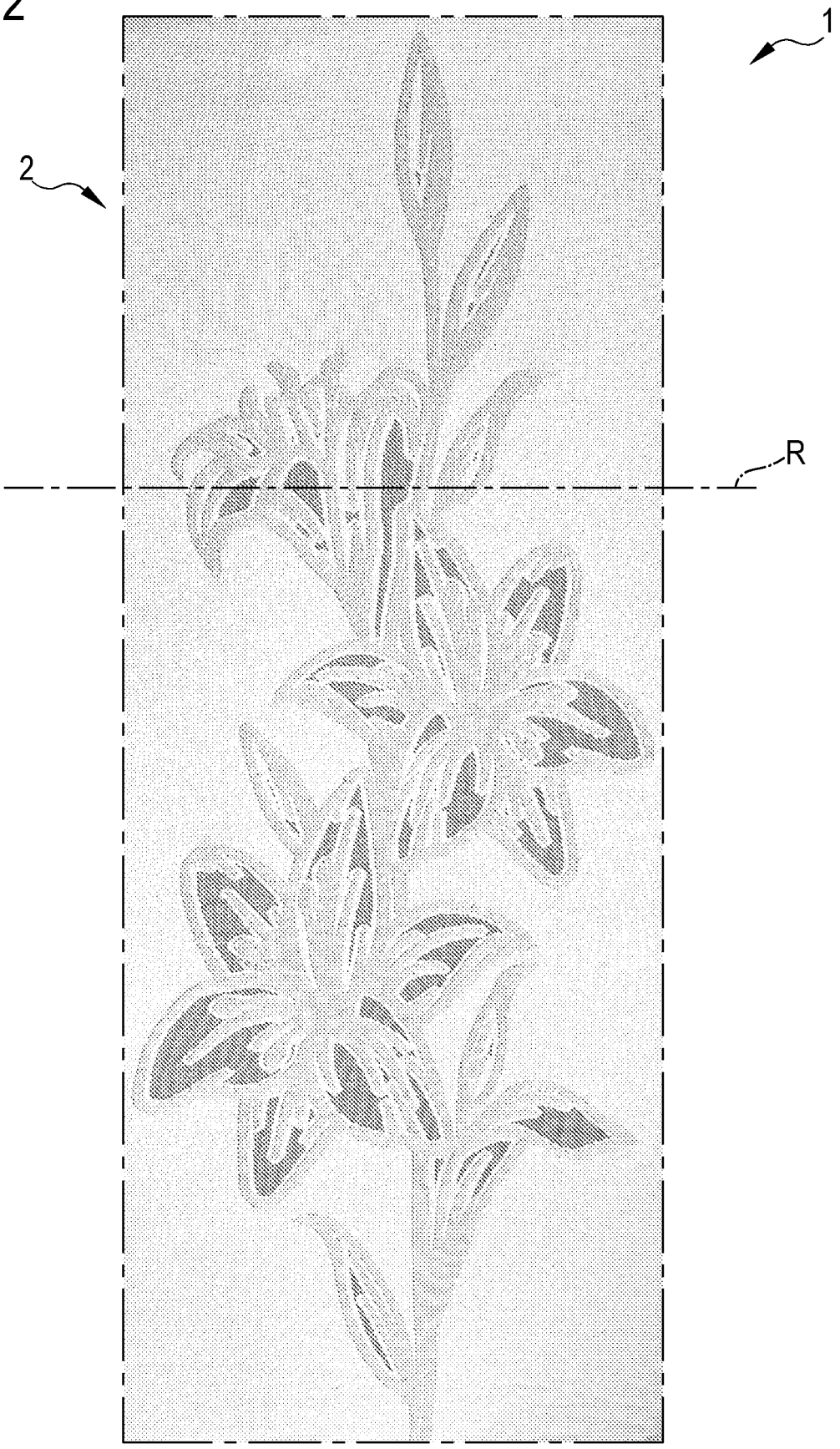
FIG. 2 shows the textile item, according to the first exemplary embodiment, of FIG. 1; in particular, it is shown the "right side" of the textile item, i.e. the external side of the tubular fabric as it is manufactured by the circular knitting machine.

FIGS. 1 and 2 shall be observed, showing a first example of textile item 1 according to the present invention (the reverse side and the right side respectively).

This item 1 has been manufactured using exemplarily a knitting machine with 8 knitted fabric feeds (in this case all) configured with at least a portion of row in terrycloth knitted fabric S. The pictures allow to notice the simultaneous presence, on single rows R in succession, of portions of terrycloth knitted fabric S and portions of floated knitted fabric F. In particular, this simultaneous presence is repeated-row by row—for numerous rows until creating a pattern/motif at will (in this case, exemplarily, highly variegated flowers).

It should be observed also the presence, on single rows R, of portions of plain knitted fabric L placed between the portions of terrycloth knitted fabric S and portions of floated knitted fabric F, i.e. the passage from the terrycloth knitted fabric to the floated knitted fabric or vice versa provides the interposition of stitches of plain knitted fabric.

In fact, if in the conditions of FIGS. 1 and 2 it is intended to manufacture in succession, on the same row R of knitted fabric, terrycloth knitted fabric S and floated knitted fabric F (or vice versa), between these two structures of knitted fabric is necessary to interpose an area of plain knitted fabric L equal to a quantity of needles having a width so as:

- during the processing of the terrycloth knitted fabric S, passing to the floated knitted fabric F, it is allowed to the bottom/tying thread to place only in the floated knitted fabric only when the trajectory of this thread does not intercept the tip of the sinkers terrycloth knitted fabric;
- during the processing of the floated knitted fabric F, passing to the terrycloth knitted fabric S, it is allowed to the bottom/tying thread to place under the tip of the sinkers terrycloth knitted fabric Substantially, if the areas of terrycloth knitted fabric or of floated knitted fabric on a same row are too close between them it would not be possible to interpose between them a corresponding area of floated knitted fabric or of terrycloth knitted fabric. For that it is provided an intermediate passage tract (in plain knitted fabric or other, and anyhow not of floated knitted fabric type) between terrycloth knitted fabric and floated knitted fabric.

Figure 3:
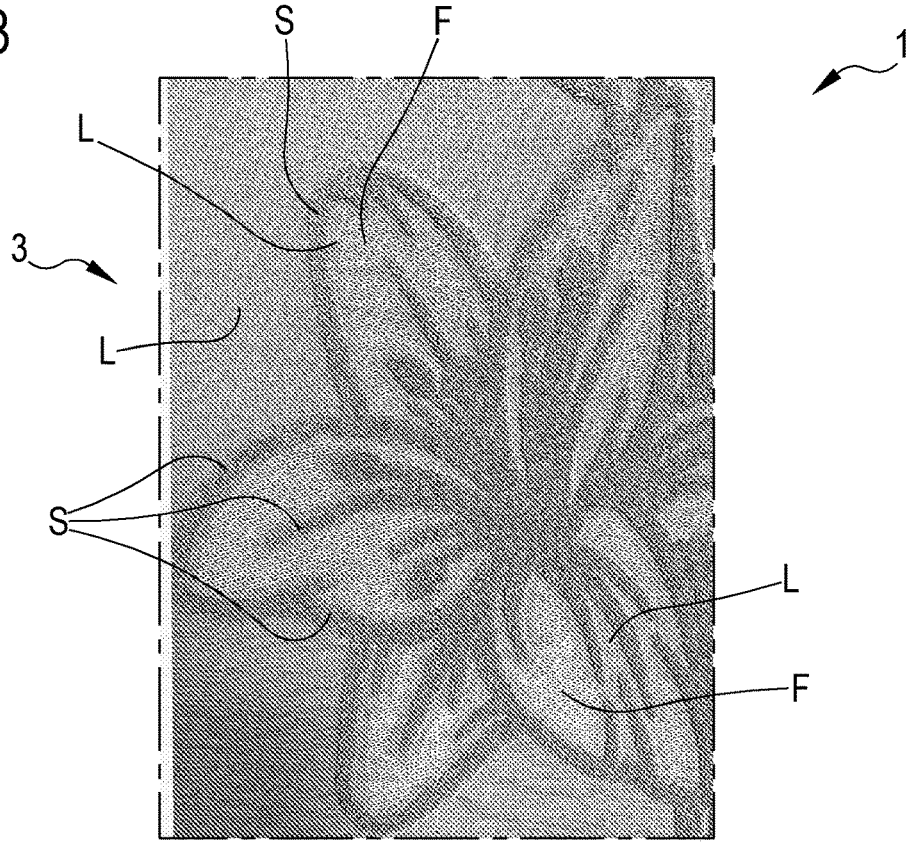
FIG. 3 shows a magnification of the textile item as for FIG. 1 (i.e. the reverse side), in particular a portion of manufactured item comprising different knitted fabric structures.
Figure 4:
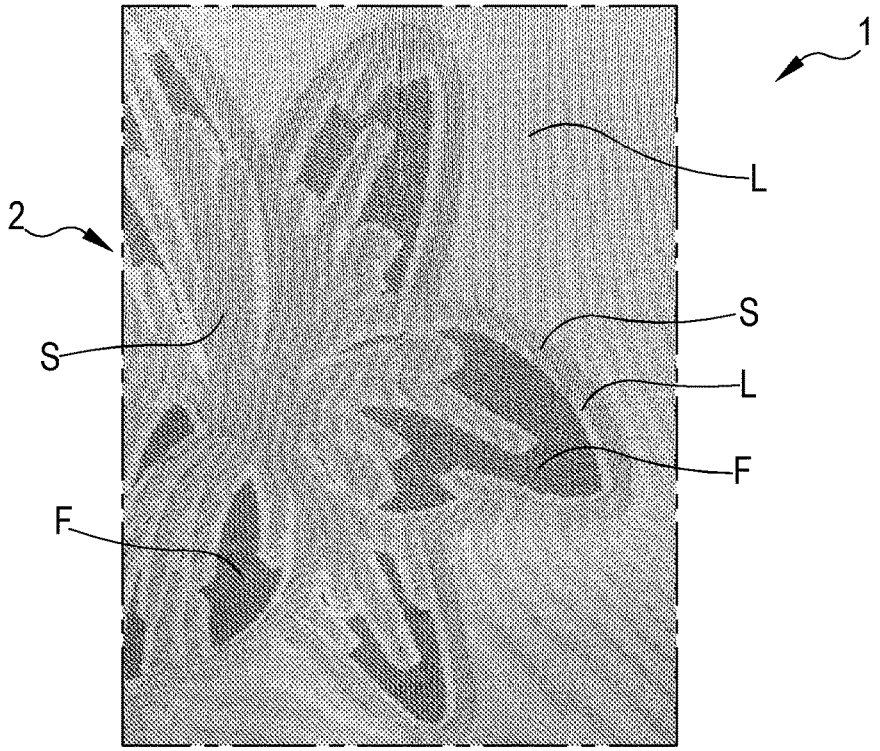
FIG. 4 shows a magnification of the textile item as for FIG. 2 (i.e. the right side) in particular a portion of manufactured item comprising different knitted fabric structures.

FIGS. 3 and 4 show magnifications of FIG. 1 and of FIG. 2 respectively, and allow to notice the different knitted fabric structures coexisting row by row and the definition of the pattern/motif.

If the aforesaid two successive rows (in this case more than two to define a complex motif) are analyzed, this manufacturing mode corresponds then to "terrycloth knitted fabric on both the successive rows+floated knitted fabric". This embodiment of the process allows to obtain, in the appearance of the knitted fabric on the right side 2, patterns designed in floated knitted fabric with a high sharpness.

Figure 5:
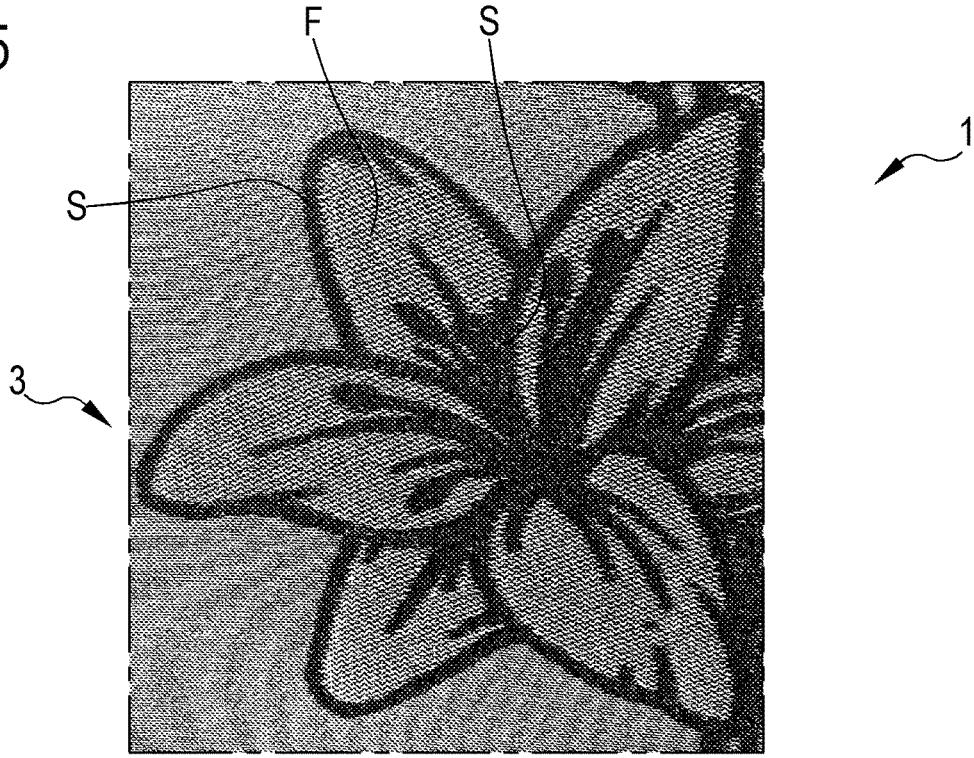
FIG. 5 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.
Figure 6:
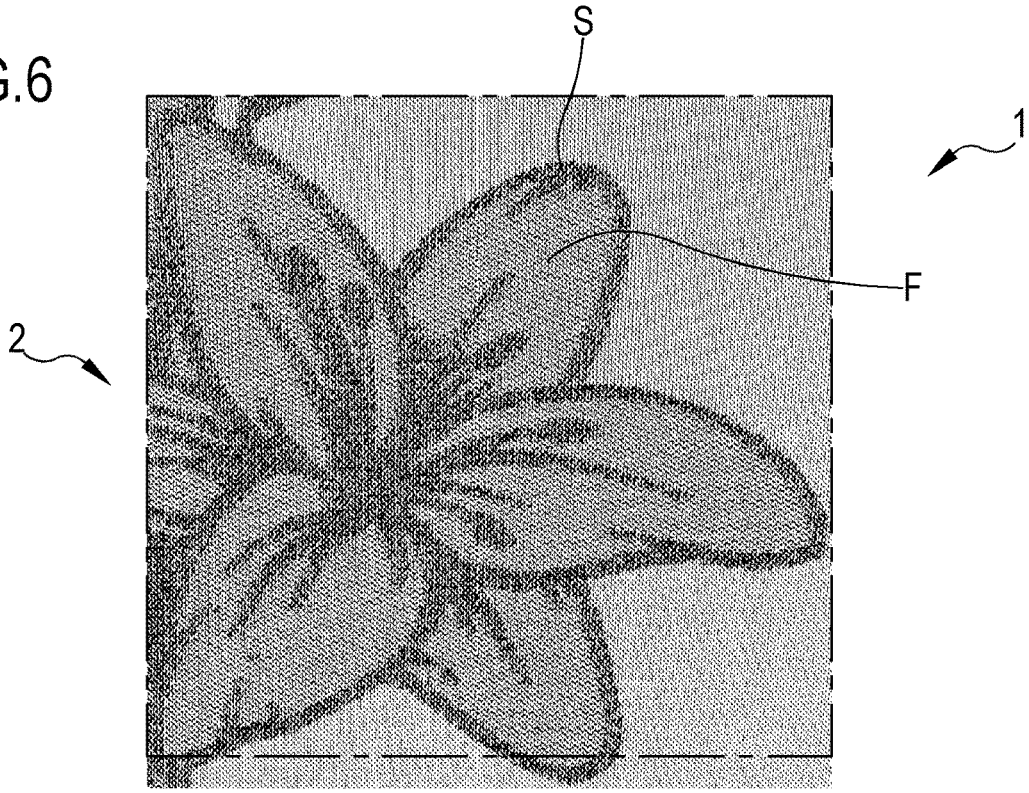
FIG. 6 shows the portion of the textile item according to the exemplary embodiment of FIG. 5, in particular showing the "right side" of the textile item, i.e. the external side of the tubular fabric as it is manufactured by the circular knitting machine.

FIGS. 5 and 6 shall be observed, showing another example of textile item 1 according to the present invention (the reverse side 3 and the right side 2 respectively).

This item has been manufactured using exemplarily a knitting machine with 8 knitted fabric feeds configured for working with alternating row, i.e. a feed that produces a portion of row in terrycloth knitted fabric and the successive feed that does not produce knitted fabric in terrycloth knitted fabric.

This causes that if in the row without terrycloth knitted fabric is present plain knitted fabric, it would result in a fabric the terrycloth knitted fabric of which has a less dense appearance (because the terrycloth knitted fabric is at alternating rows): Therefore, it is provided—in the row without terrycloth knitted fabric-a structure of knitted fabric of jacquard type by introducing a selection of type 1×1 (an operating needle and the successive non-operating) or other selection (for example 1×2, 1×3, etc.) so as to:

- merge/approach with each other the two stitch rows in terrycloth knitted fabric (which are alternating with each other, i.e., separated by an interposed row without terrycloth knitted fabric), simulating an aesthetic effect similar to having terrycloth knitted fabric on all the successive rows to each other, thus improving the appearance of the fabric obtained;

be able to introduce different structures of knitted fabric, on the row lacking terrycloth knitted fabric, so as to produce a fabric that allows combinations of workings that could not be reproduced or could be reproduced only to a limited extent if they were made with the simultaneous presence of terrycloth knitted fabric on all the stitch rows.

Practically, analyzing the reverse side of FIG. 5, produced with light-colored bottom/tie thread and dark-colored terrycloth knitted fabric thread, it can be noticed a fantasy terrycloth knitted fabric S working with all the rest of the knitted fabric produced in floated knitted fabric F that alternates at each row R.

In other words, it can be observed that in FIGS. 5 and 6 the passage between terrycloth knitted fabric S and floated knitted fabric F and vice versa takes place—in the whole motif—in a direct and immediate way, without interposition of plain knitted fabric (as is the case with the FIGS. 1-4): this is possible because the embodiment of FIGS. 5-6 actually provides for a terrycloth knitted fabric with alternating rows (and not on each row R).

This condition would not be reproducible if it were defined as terrycloth knitted fabric S on all rows, because as shown above, it would not be possible to manufacture, on the same row, the floated knitted fabric F in direct succession to the terrycloth knitted fabric and vice versa.

The terrycloth knitted fabric with alternating row, then, even if less dense (with respect to the case of FIGS. 1-4), allows to let free the rows without terrycloth knitted fabric for manufacturing different structures of knitted fabric without limitations, and then to manufacture motifs and patterns that visually simulate direct passages between terrycloth knitted fabric S and floated knitted fabric F.

If the above defined "two successive rows" are analyzed, the processing mode of FIGS. 5 and 6 corresponds then to "terrycloth knitted fabric with alternating rows+floated knitted fabric".

Figure 7:
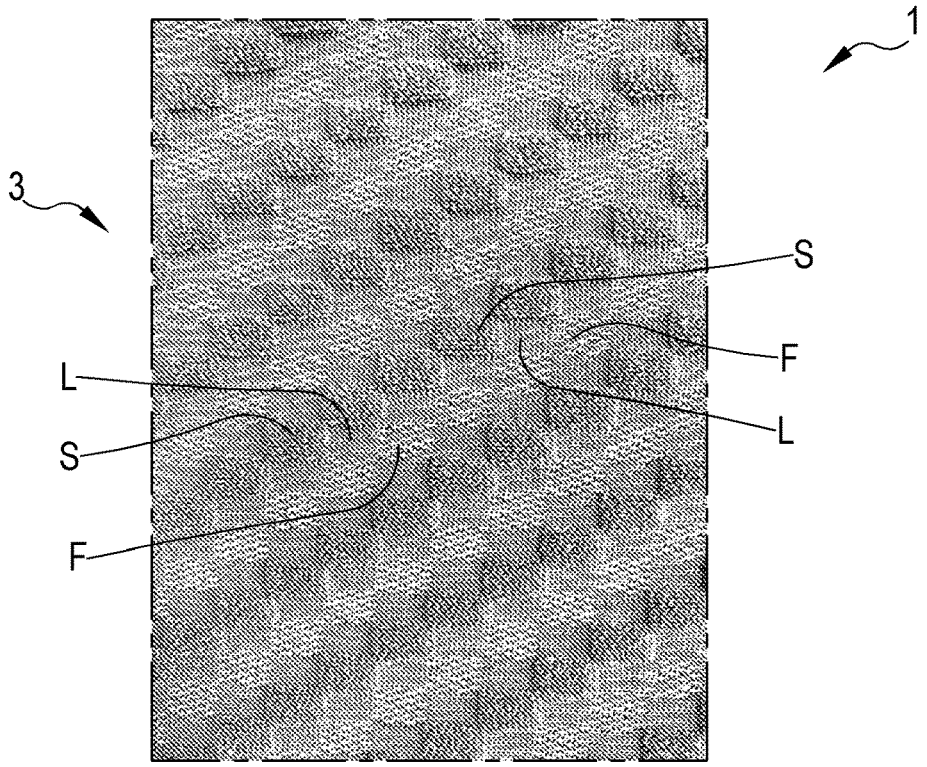
FIG. 7 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.

FIG. 7 shall be observed, showing another example of the textile item 1 according to the present invention (reverse side 3).

This item 1, as the one shown in FIGS. 1-4, has been manufactured using all the 8 feeds of knitted fabric configured (all of them) with at least a portion of row in terrycloth knitted fabric S.

The picture allows us to notice the simultaneous presence, on each single row R in succession, of portions of terrycloth knitted fabric S, portions of floated knitted fabric F, and portions of plain knitted fabric L. In particular, such simultaneous presence is repeated-row by row—for numerous rows until a pattern/motif with alternating squares, on diagonal lines, is made.

In particular this item 1 has been manufactured to quantify, in quantity of needles, the area of plain knitted fabric L necessary to be able to obtain terrycloth knitted fabric S and floated knitted fabric F in succession or vice versa. The quantity of needles to be used for the manufacture of plain knitted fabric, necessary to switch in succession from terrycloth knitted fabric to floated knitted fabric and vice versa, can be exemplarily 10 needles on a knitting machine in E28 fineness (i.e., 28 needles per inch).

Please observe that all the textile items up here shown can be considered as "externable", i.e. once worn the reverse side of the garment remains exposed, thus enhancing the three-dimensionality of the structure of the knitted fabric, in particular the terrycloth knitted fabric.

FIG. 8 shall be observed, showing another example of the textile item 1 according to the present invention (reverse side 3).

This item of FIG. 8, as the one shown in FIGS. 1-4 and 7, has been manufactured using all the 8 feeds of knitted fabric configured (all of them) with at least a portion of row in terrycloth knitted fabric. In this case, however, it is not simultaneously present the floated knitted fabric, but rather the portions not in terrycloth knitted fabric are in plain knitted fabric In this case, the fabric is manufactured with the following programming:

in a number of rows R of knitted fabric in succession, i.e., consecutive to each other, there are portions of terrycloth knitted fabric S alternating with portions of plain knitted fabric L, in identically repeated positions;

subsequently the inversion of the portions of terrycloth knitted fabric S with the portions of plain knitted fabric L takes place, for an additional number of rows R of knitted fabric in succession.

The picture allows us to notice the simultaneous presence, on each individual row in succession, of portions of terrycloth knitted fabric S and portions of plain knitted fabric L, alternating with groups of rows R to create a checkered pattern/motif (terrycloth knitted fabric/plain knitted fabric).

Figure 9:
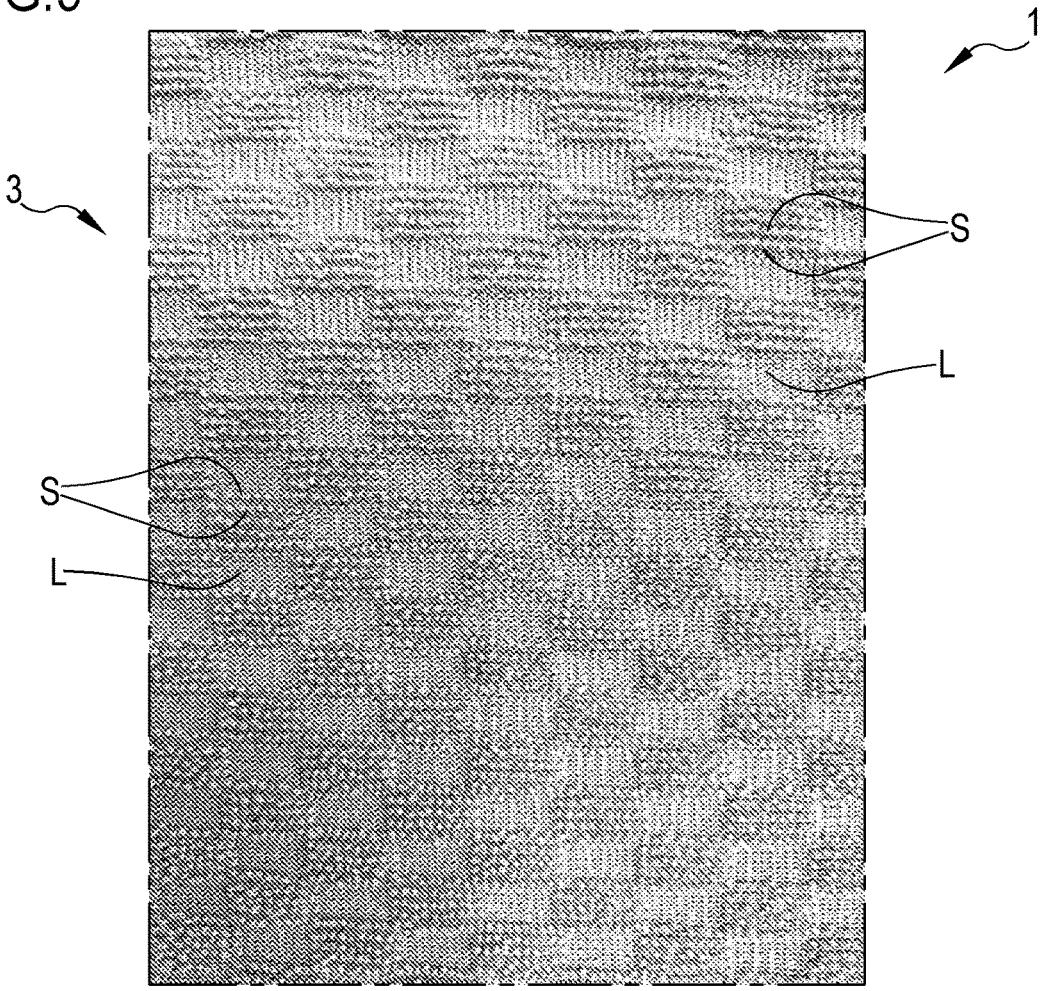
FIG. 9 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.

FIG. 9 shall be observed, showing another example of the textile item 1 according to the present invention (reverse side 3).

This item, as the one shown in FIGS. 5-6, has been manufactured using 8 feeds of knitted fabric configured to work with alternating row, i.e. a feed that produces a portion of row in terrycloth knitted fabric and the successive feed that does not produces knitted fabric in terrycloth knitted fabric. In this case, the alternating rows without terrycloth knitted fabric exhibit plain knitted fabric (it is not simultaneously present floated knitted fabric).

In this case, the fabric is manufactured with the following programming:

considering two rows R of knitted fabric in succession, that is, consecutive to each other, in the first row is present a portion of terrycloth knitted fabric S, while the second row is without terrycloth knitted fabric;

the designed motif is constituted by a serial repetition—for a certain number of times—of the two successive stitch rows, so as to obtain a structure with alternating rows, consisting of an alternating sequence of first rows and second rows of said two successive rows.

Since one row out of every two is without terrycloth knitted fabric, it is obtained a fabric with less dense areas of terrycloth knitted fabric; however, it is possible to introduce different structures of knitted fabric in the row lacking terrycloth knitted fabric, e.g., combinations of workings that cannot be reproduced or can be reproduced only to a limited extent if they were manufactured with the simultaneous presence of terrycloth knitted fabric on all the stitch rows.

Furthermore, the motif/pattern of FIG. 9 provides for a change of position of the terrycloth knitted fabric S sections after a certain number of pairs of successive rows R, creating a checkered pattern/motif (alternating terrycloth knitted fabric/plain knitted fabric).

Figure 10:
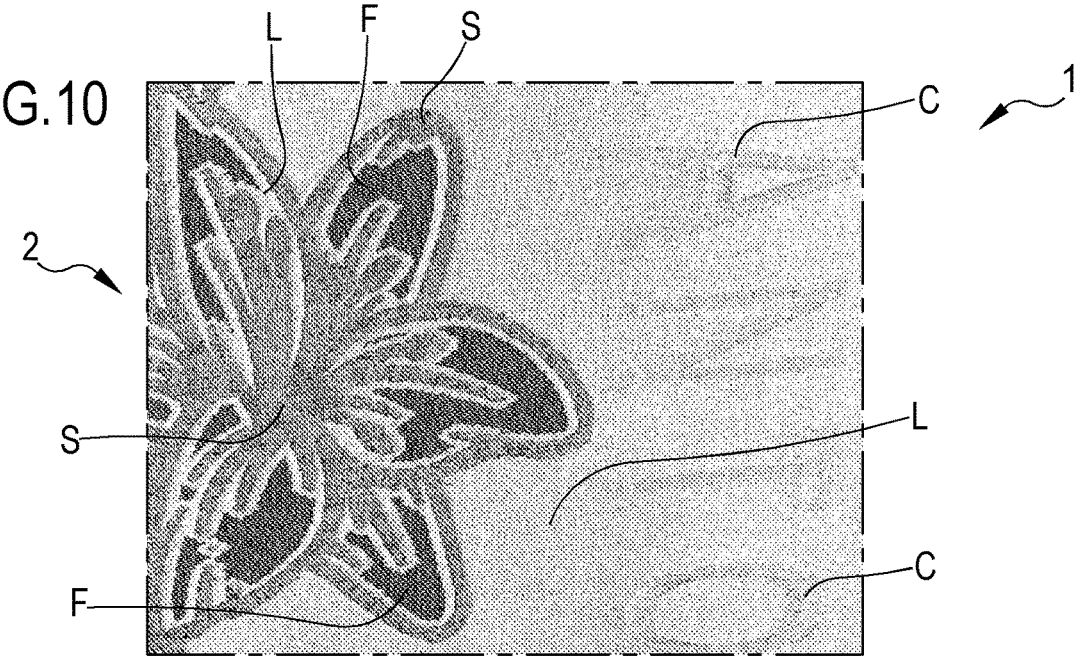
FIG. 10 shows a portion of another embodiment, of exemplary type, of a textile item manufactured by means of the process according to the present invention; in particular, is shown the "right side" of the textile item, i.e. the external side of the tubular fabric as it is manufactured by the circular knitting machine.

FIG. 10 shall be observed, showing another example of the textile item 1 according to the present invention (right side 2).

This item has been manufactured using the machine configured with the enlarged feeds: this configuration provides for halving the production of stitch rows at each cylinder revolution (in the previous examples, each cylinder revolution allows for producing 8 stitch rows), but at the same time it allows to increase the textile possibilities, because at each feed of knitted fabric both the needle-needle selection points and the available thread guides are doubled.

In the case of FIG. 10 the knitting machine is configured with 4 feeds of knitted fabric (4 rows produced each cylinder revolution). In the first part of the enlarged feed is then possible to insert a colored thread (indicated with C) for manufacturing lettering, logos or graphic elements (in FIG. 10 the letters "A N T O" visible in the right part), while in the second part of the enlarged feed takes place the formation of the knitted fabric and specifically the production of knitted fabric in terrycloth knitted fabric S, plain L and floated knitted fabric F (visible in the flower motif in the left part of FIG. 10). Please observe that the thread inserted for manufacturing the lettering is different (e.g., in color and/or characteristics) from the threads used in the flower motif. This embodiment allows to obtain-on a same row—the simultaneous presence of portions of terrycloth knitted fabric S, smooth L, and floated knitted fabric F and of portions of knitted fabric with yarn added for manufacturing logos and graphic elements (for example, the letters indicated with the reference C in FIG. 10). In the context of structures of knitted fabric with terrycloth knitted fabric-floated knitted fabric combinations here described, further relevant aspects that characterize such new structures of knitted fabric are highlighted. For example, it is noted that:

- the processing of terrycloth knitted fabric typically provides:
  - a first yarn guide that dispenses the thread that produces the terrycloth knitted fabric curl (usually a thick thread);
  - a second yarn guide that dispenses the bottom/tie thread of the terrycloth knitted fabric (usually a thick thread);
- the processing of the floated knitted fabric typically provides:
  - a first yarn guide that dispenses the bottom thread (usually fine);
  - a second yarn guide that dispenses the colored bottom thread (usually thick).

By analyzing these conditions, it can be seen that if both terrycloth knitted fabric S and floated knitted fabric F are produced on the same row R of knitted fabric, the threads used are necessarily the same, and therefore the floated knitted fabric is likely to be unappreciated because it is not very noticeable (unless a colored thread is used).

On the contrary, if the terrycloth knitted fabric S and the floated knitted fabric F are manufactured on two separate stitch rows (i.e., on alternating rows), with the terrycloth knitted fabric on a first row and the floated knitted fabric on the second row (or vice versa), both of these structures can enjoy their specificity by using appropriate types of threads.

Thus, the floated knitted fabric F is much more appreciable in the configuration with alternating rows, however, it has been observed that this takes place at the expense of the terrycloth knitted fabric S, which results necessarily lighter and less dense, precisely because it is knitted one row yes and one row no.

The latter condition can be remedied by interposing between the two portions of rows in terrycloth knitted fabric (in the mode with alternating rows), of the knitted fabric in jacquard rather than plain knitted fabric, i.e., knitted fabric with floats (non-operating needles) thus allowing for an approaching of the aforementioned two portions of knitted fabric in terrycloth knitted fabric. Alternatively, in order to bring the two portions of knitted fabric in terrycloth knitted fabric closer together, is also possible to manufacture narrower floats of knitted fabric, that is, with a lower density of knitted fabric.

In addition, also in this case in order to enhance the effect of the structure of floated knitted fabric, as well as for terrycloth knitted fabric, is possible to use differently colored yarns.

The results of these different programming possibilities, all of which can be implemented in the process of the present invention, are shown here by showing some examples of textile items (FIGS. 11-16 and 5-6).

Figure 11:
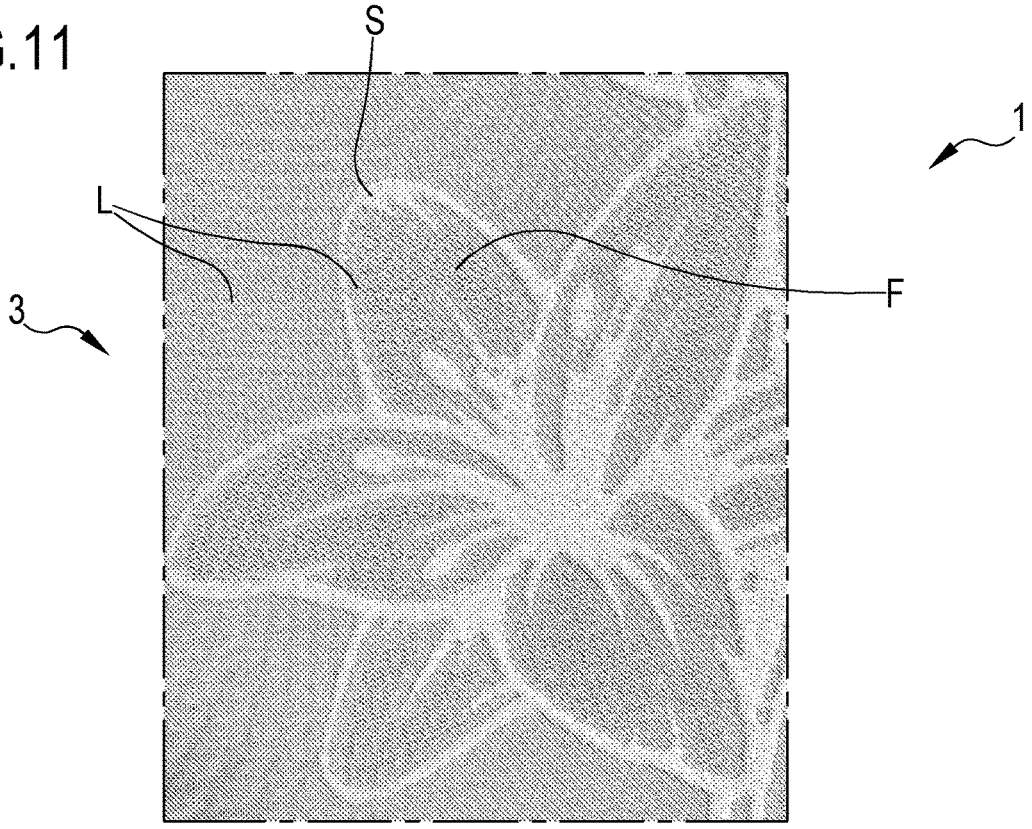
FIG. 11 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.
Figure 12:
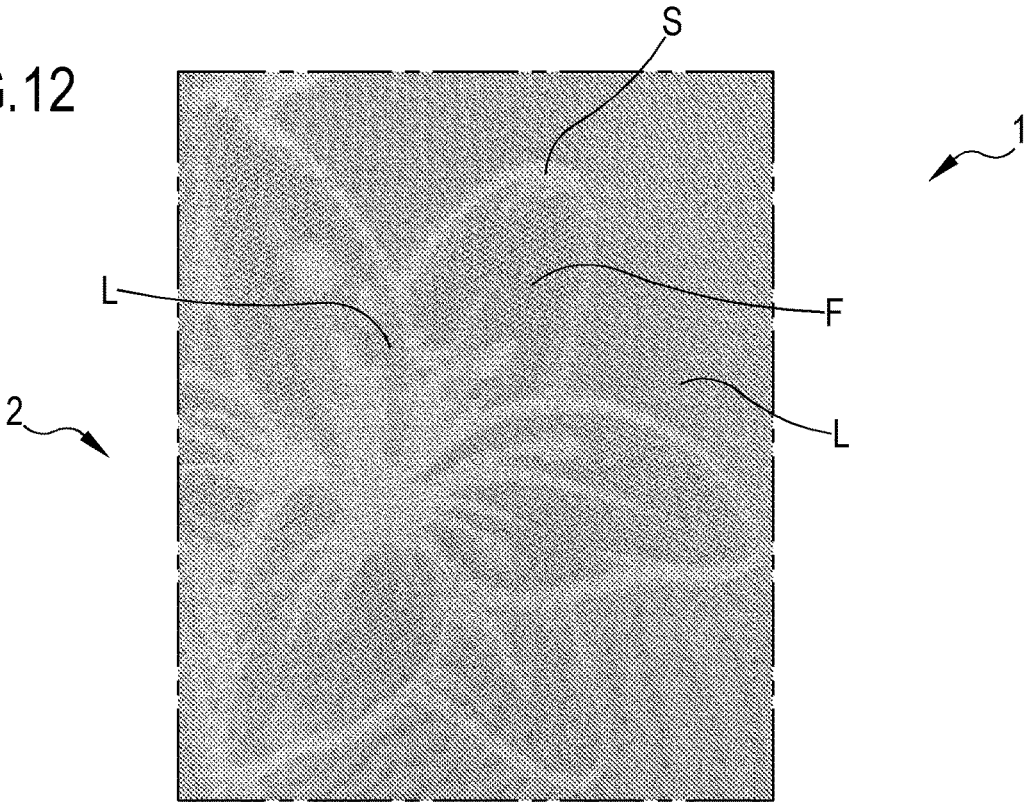
FIG. 12 shows a portion of the textile item according to the exemplary embodiment of FIG. 11, in particular showing the "right side" of the textile item, i.e. the external side of the tubular fabric as it is manufactured by the circular knitting machine.

FIGS. 11 and 12 show a further example of the textile item 1 according to the present invention (reverse side 3 and right side 2 respectively).

In this case the textile item 1 provides the simultaneous presence, on the same stitch rows, of both portions of terrycloth knitted fabric S and portions of floated knitted fabric F; therefore, the threads used are the same (in neutral color) and for this reason the floated knitted fabric is less appreciable (please observe in particular the reverse side of FIG. 11).

Figure 13:
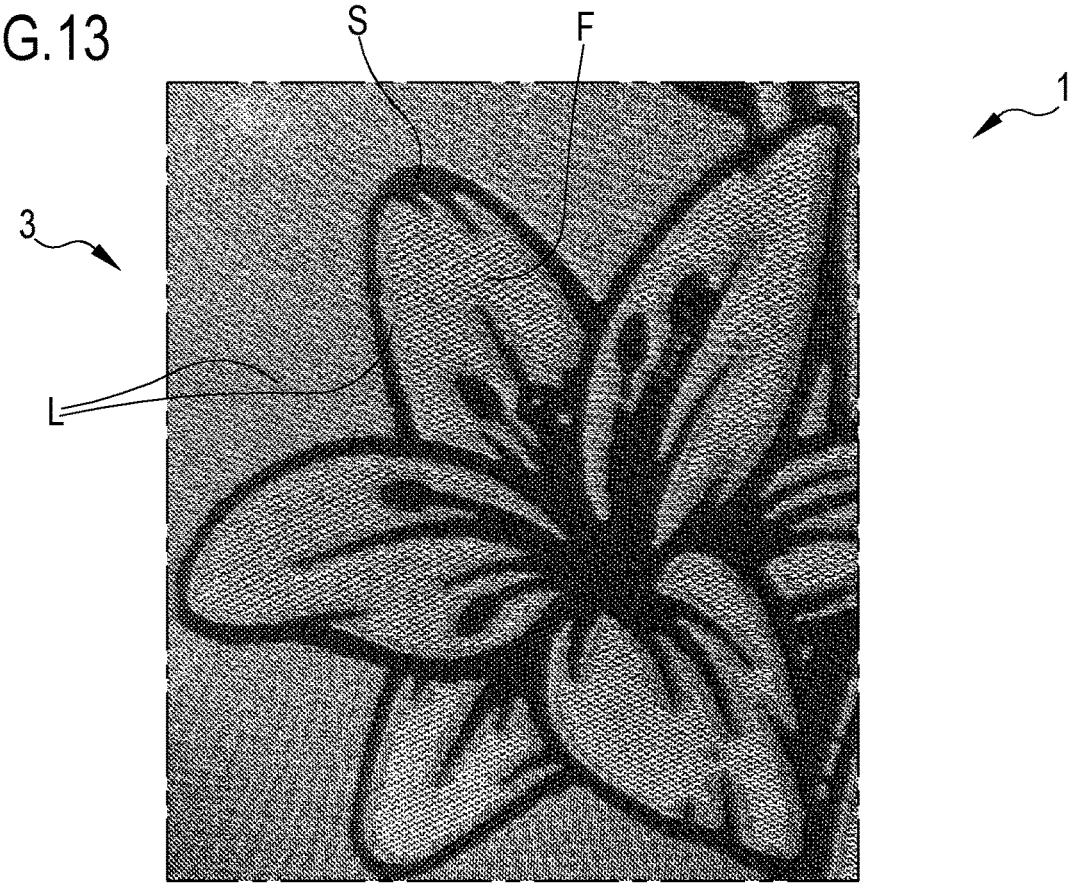
FIG. 13 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.
Figure 14:
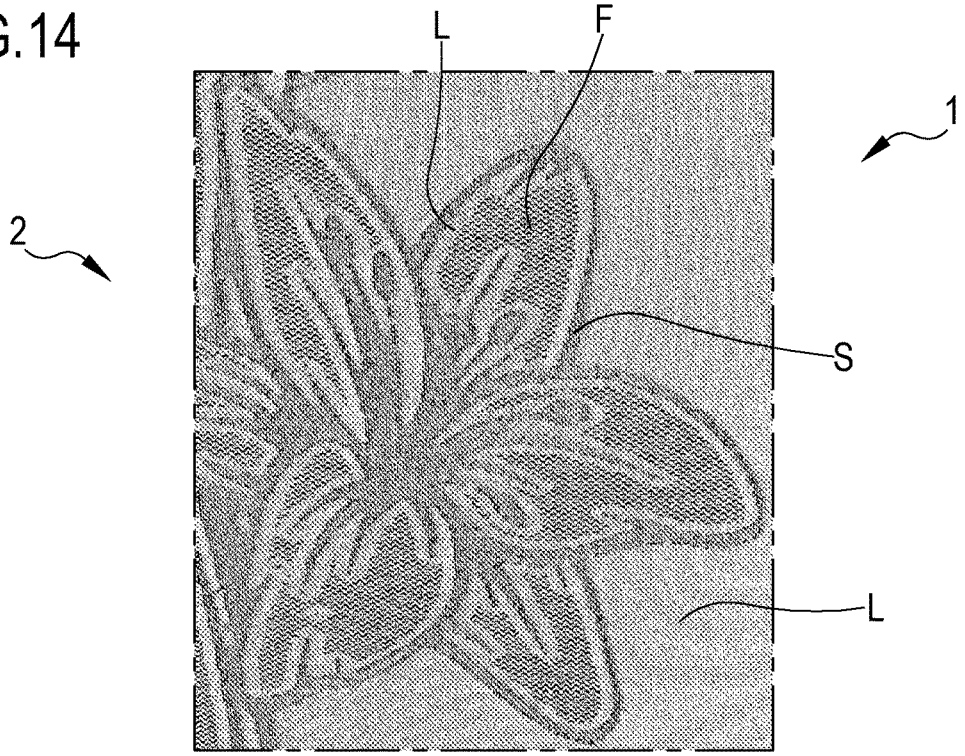
FIG. 14 shows a portion of the textile item according to the exemplary embodiment of FIG. 13, in particular showing the "right side" of the textile item, i.e. the external side of the tubular fabric as it is manufactured by the circular knitting machine.

FIGS. 13 and 14 show a further example of the textile item 1 according to the present invention (reverse side 3 and right side 2, respectively).

Also in this case, the textile item 1 provides the presence, on the same stitch rows, of both portions of terrycloth knitted fabric S and portions of floated knitted fabric F; however—unlike the case shown in FIGS. 11-12—threads of different types/colors are used (in this case neutral-colored yarns except for the terrycloth knitted fabric yarn, which is black), allowing the floated knitted fabric to be distinguished by making it stand out on the right side of the fabric.

Figure 15:
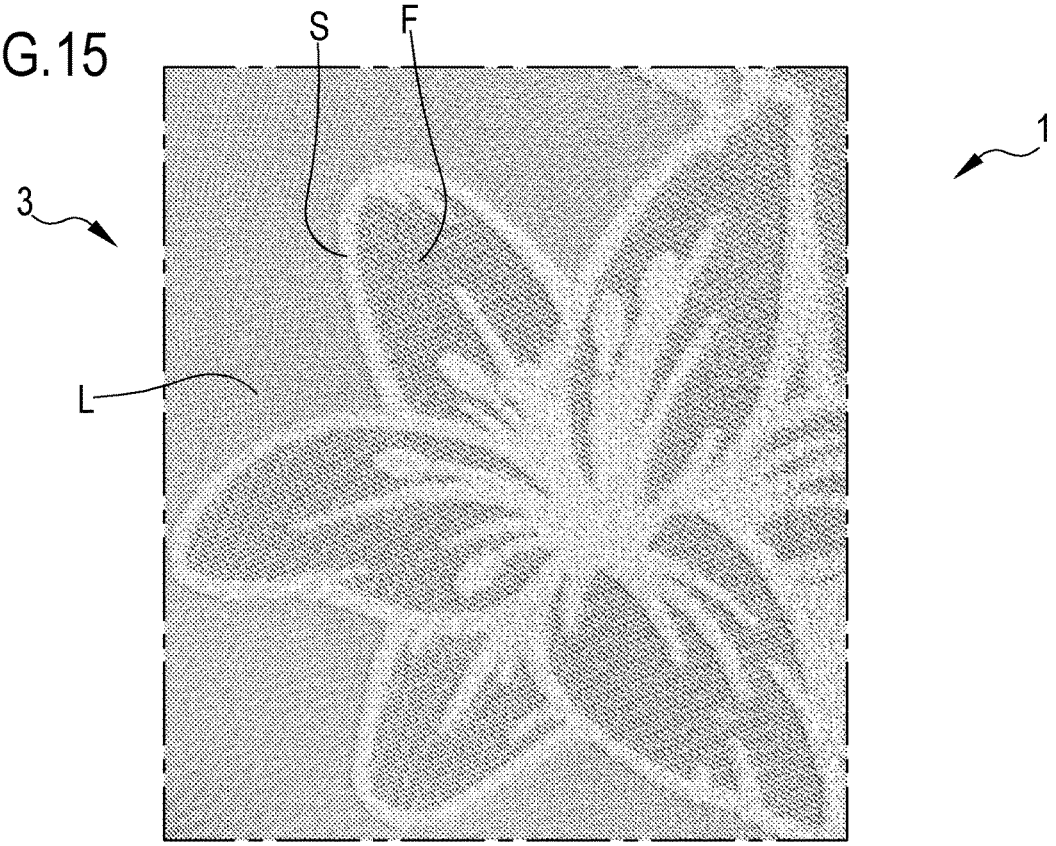
FIG. 15 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.
Figure 16:
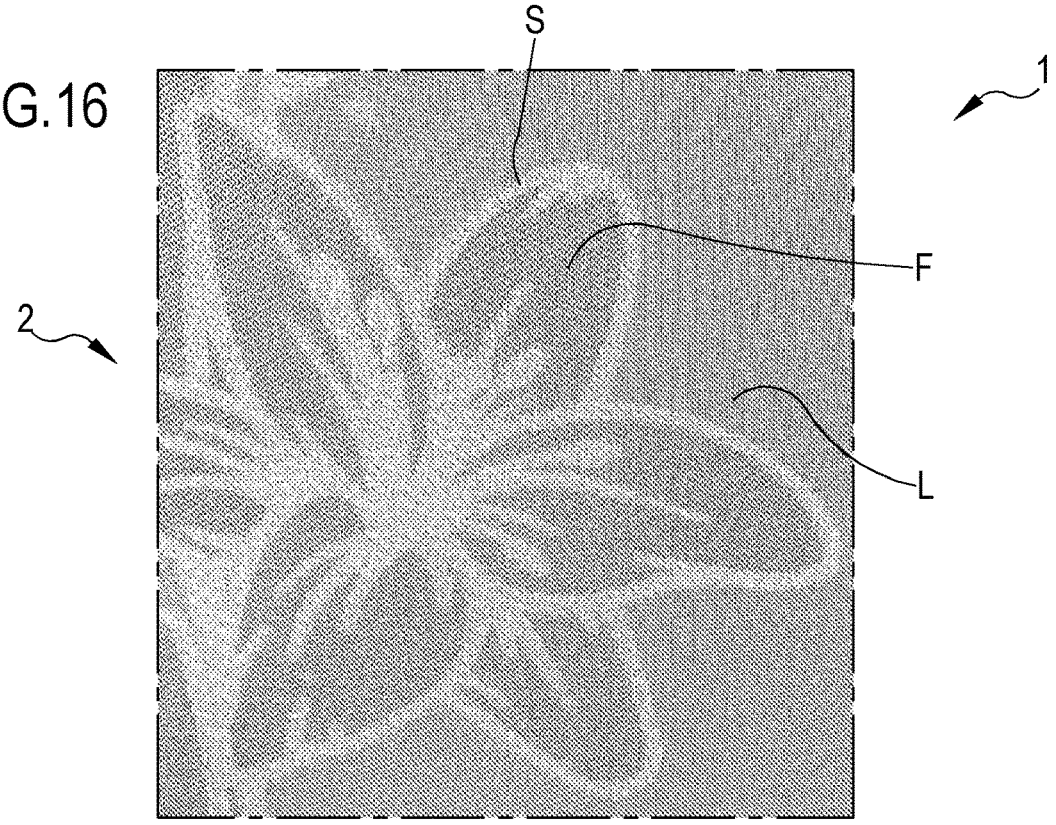
FIG. 16 shows a portion of the textile item according to the exemplary embodiment of FIG. 15, in particular showing the "right side" of the textile item, i.e. the external side of the tubular fabric as it is manufactured by the circular knitting machine.

FIGS. 15 and 16 shall now be observed, showing a further example of the textile item 1 according to the present invention (reverse side 3 and right side 2, respectively).

In this case, the textile item 1 provides that the terrycloth knitted fabric and the floated knitted fabric are manufactured on two separate stitch rows, terrycloth knitted fabric S on the one and floated knitted fabric F on the other (or vice versa); there is substantially the above described configuration with alternating rows, which allows to enhance the specificity of both structures of knitted fabric (terrycloth knitted fabric and floated knitted fabric), using appropriate types of threads.

As explained above, the floated knitted fabric F becomes much more appreciable in this configuration, to the expense of the terrycloth knitted fabric S, which becomes lighter because it is knitted one row on and one row no. In order to overcome this limitation, it is possible to interpose knitted fabric in jacquard (or shrink the floats of knitted fabric) between the portions of terrycloth knitted fabric in alternating rows: this solution is shown precisely in FIGS. 15 and 16. In this case the terrycloth knitted fabric, although with alternating rows, is made more dense thanks to the interposition of knitted fabric in jacquard, and the floated knitted fabric results sharper (observe in particular the reverse side of FIG. 15). This is the case even though—as in FIGS. 15 and 16—all the threads used are of neutral color (white/gray).

In order to enhance even better the effect of the structure of floated knitted fabric, as well as for terrycloth knitted fabric, it is possible to modify the configuration of FIGS. 15 and 16 by using differently colored threads: this is the case of the textile item in FIGS. 5 and 6.

These figures show a further example of the textile item according to the present invention (reverse and right side, respectively).

Also in this case the textile item has a structure with alternating rows, with terrycloth knitted fabric and floated knitted fabric manufactured on two separate stitch rows (terrycloth knitted fabric on one and floated knitted fabric on the other—or vice versa). However, in contrast to what is shown in the case of FIGS. 15-16, threads of different types/colors are used in the item of FIGS. 5 and 6: in particular, these are all threads in neutral color (white/gray) except terrycloth knitted fabric and bottom thread both black in color.

This allows to better distinguish the terrycloth knitted fabric and floated knitted fabric, making them stand out within the motif/pattern (observe reverse side of FIG. 5 and right side of FIG. 6).

Figure 17:
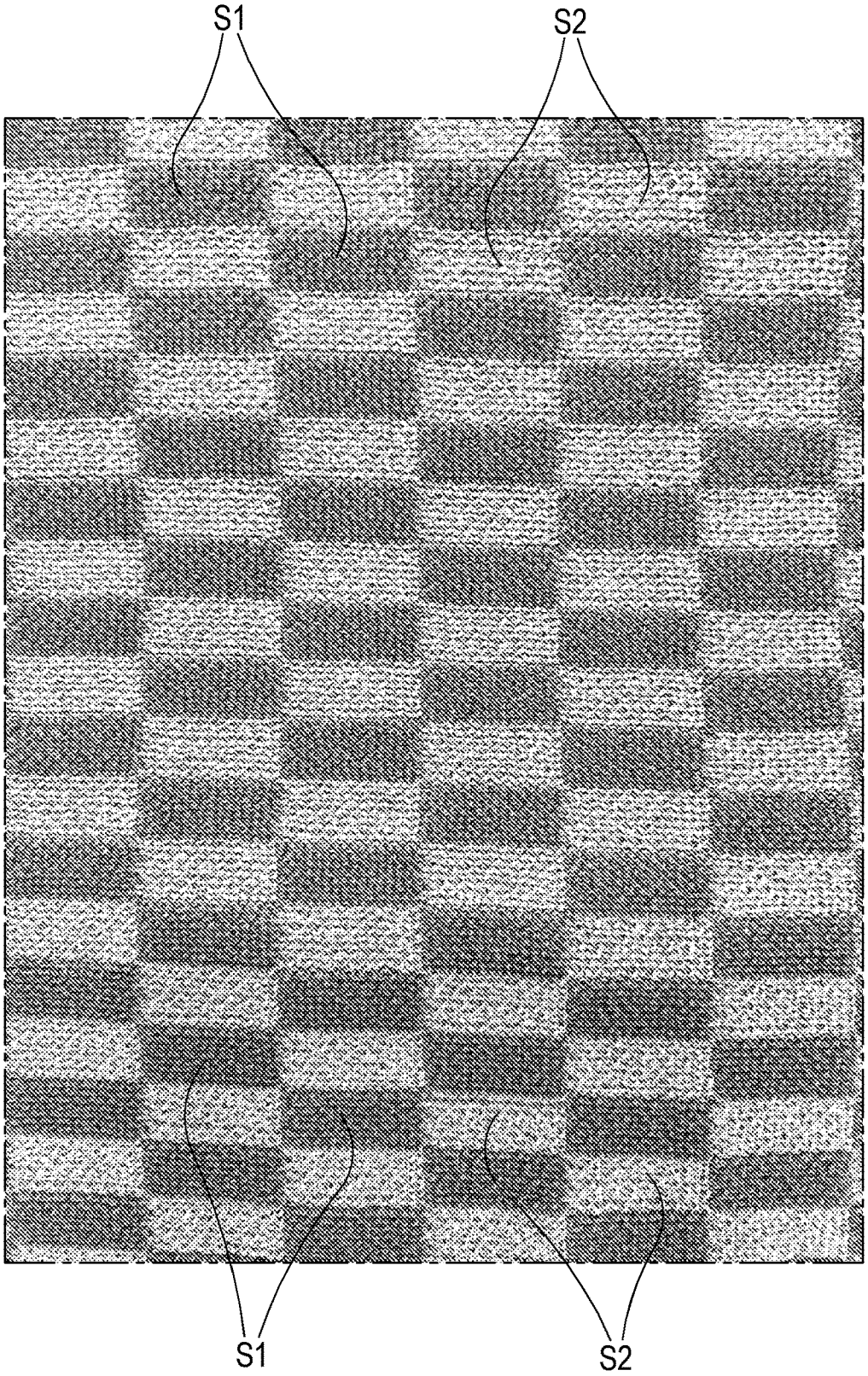
FIG. 17 shows a portion of another embodiment, of exemplary type, of a textile item manufactured by means of the process according to the present invention; in particular, is shown the "reverse side" of the textile item, i.e. the internal side of the tubular fabric as it is manufactured by the circular knitting machine.

Observe now FIG. 17, which shows a further example of textile item 1 according to the present invention (in particular the reverse side).

Such a further possible embodiment of textile item provides the simultaneous presence, within the programmed motif/pattern, of two types of terrycloth knitted fabric of two different colors (or in general manufactured with two threads having different characteristics).

In this case, a "first terrycloth knitted fabric" S1 and a "second terrycloth knitted fabric" S2 are manufactured on two distinct stitch rows: first terrycloth knitted fabric on one and second terrycloth knitted fabric on the other (or vice versa), i.e., according to the "alternating rows" configuration.

Therefore the motif/pattern exhibits an alternating sequence of first rows with first terrycloth knitted fabric S1 and of second rows with second terrycloth knitted fabric S2, repeated for a certain number of times. In these first and second rows the first terrycloth knitted fabric S1 and the second terrycloth knitted fabric S2 are placed in determined portions so as to manufacture, overall, a pattern in which areas of first terrycloth knitted fabric and areas of second terrycloth knitted fabric are shown. According to the programming of the knitting machine, as a result it is possible to obtain a pattern in which areas of first terrycloth knitted fabric S1 are comprised inside areas of second terrycloth knitted fabric S2, or vice versa, even if on each row considered are not present simultaneously both the first terrycloth knitted fabric and the second terrycloth knitted fabric (being precisely with alternating rows).

As above explained, being in a case of a configuration of terrycloth knitted fabric with alternating rows, each of the two terrycloth knitted fabrics (first and second) results "lightened", because processed one row yes and one row no.

Also in this case it is possible to interpose knitted fabric in jacquard (or shrink the floats of knitted fabric) between the portions of terrycloth knitted fabric in alternating rows. In this case the jacquard knitted fabric or the shrinking of the floats of knitted fabric are manufactured:

- for the first terrycloth knitted fabric S1 in intermediate rows (without the first terrycloth knitted fabric but associated to the second terrycloth knitted fabric) and in particular in the intermediate portions between two portions of first terrycloth knitted fabric;
- for the second terrycloth knitted fabric S2 in intermediate rows (without the second terrycloth knitted fabric but associated to the first terrycloth knitted fabric) and in particular in the intermediate portions between two portions of second terrycloth knitted fabric.

In this way the first and the second terrycloth knitted fabric, even if with alternating rows, are made denser thanks to the interposition of knitted fabric in jacquard or of floats of narrow knitted fabric, and the overall pattern with two terrycloth knitted fabrics (of different color/typology) results sharper.

Generally, it can be observed, as clearly shown in all the figures, that in the context of the present invention at least a portion of the fabric that constitutes the textile item exhibits "areas" (shaped areas) differentiated at level of typology of knitted fabric (terrycloth knitted fabric, floated knitted fabric, plain knitted fabric, etc.), and the designed motif allows that each row of knitted fabric can cross/intersect, along its development, several different areas. This is because on the row we saw several different portions being defined simultaneously (in particular combined terrycloth knitted fabric and floated knitted fabric).

Therefore, for example, a row of knitted fabric can "intersect/cross" areas of terrycloth knitted fabric alternating with areas of floated knitted fabric, etc., based on the defined mot.

In a similar way, it can be stated that different areas (for example, one area in knitted fabric terrycloth and one in floated knitted fabric) have one or more stitch rows in common, i.e. share portions of the same rows.

As it can be seen from the description carried out, a characterizing aspect of the textile items according to the present invention is the production of knitted fabric in knitted terrycloth fabric combined with floated knitted fabric, and the combination can be performed both on the same row and on "alternating rows" (on two consecutive stitch rows).

In the first case, wherein it is manufactured on the same row both the terrycloth knitted fabric in needle-needle selection and the floated knitted fabric, the two structures of knitted fabric are typically "interrupted" (i.e. separated from each other) by an area of plain knitted fabric; however, both the structures of knitted fabric result well highlighted because present on all the stitch rows.

In the second case, wherein the combination is manufactured with "alternating rows" (on two consecutive rows), with terrycloth knitted fabric in needle-needle selection on the first row and floated knitted fabric on the second row (or vice versa), the two structures of knitted fabric can be superimposed without any limit, but with the drawback that the quality or the esthetical result, both of the terrycloth knitted fabric and of the floated knitted fabric, is lower because the two structures of knitted fabric are with alternating rows and therefore "hide" the one with the other resulting less evident, because they are not present on all the stitch rows.

In any case, both the solution allows to obtain a high versatility at programming level, and then to obtain various typologies of textile items, each one provided with respective peculiarities.

The present invention achieves important advantages.

First of all, the invention allows to overcome the drawbacks of the known technique.

The Applicant has first of all verified that the textile items according to the invention have a high quality, relevant technical qualities and valuable aesthetic characteristics.

The Applicant has also verified that the process according to the invention allows to:

- provide the necessary versatility in terms of combinations of structures of knitted fabric obtainable on a single textile item (as proved by all the exemplary embodiments shown in FIGS. 1-17);

manufacture a textile item with specific structural characteristics able to confer certain technical properties to the item itself;

manufacture a textile item with specific esthetical characteristics and/or of comfort and fit;

manufacture a textile item characterized by a stable structure and not subject to defects or imperfections;

manufacture textile items in an economically competitive way;

manufacture patterns and motifs, also complex and detailed, on a single textile item;

obtain specific esthetical effects on a single textile item;

create alternating solutions, with respect to the known technique, in the embodiment of knitted fabric textile items, and to open new pattern fields in the development of textile items manufactured with circular machines of seamless type.

The invention claimed is:

1. A process for manufacturing a textile item (1) by means of a circular weft knitting machine, the process comprising the steps of:

arranging a circular knitting machine having the following features:

the circular knitting machine is a circular weft knitting machine;

the circular knitting machine is a seamless circular knitting machine;

the circular knitting machine comprises at least one feed and a needle-bearing organ supporting a plurality of needles, defining a circular needle bed, which can be operated to pick up the threads dispensed by said at least one feed and to form weft knitted fabric; said needle-bearing organ being rotatable relative to said feed and said feed being arranged in proximity to said needle-bearing organ;

the circular knitting machine comprises a plurality of knockover sinkers, which are operatively associated with said plurality of needles;

programming said knitting machine so as to define a textile item to be manufactured, said textile item consisting of a plurality of successive stitch rows (R);

producing weft knitted fabric with said circular knitting machine so as to manufacture said textile item, according with the aforesaid programming step;

wherein in said programming step at least one designed motif is set, defined on at least two successive stitch rows, following one another, in which a portion of terrycloth knitted fabric (S) is present in at least one of the two successive rows, and wherein said designed motif, set in said programming step, is defined on a plurality of consecutive rows and consists of a serial repetition, for a certain number of times more than 1, of said two successive stitch rows, so as to obtain a structure with alternating rows, consisting of an alternating sequence of first rows and second rows of said two successive rows.

2. The process according to claim 1, wherein in said step of arranging a circular knitting machine, the circular knitting machine is structured so as to enable a needle-needle selection, and the circular knitting machine is structured so as to individually select any desired needle and activate the respective sinker, so as to allow the execution of special stitches in certain desired positions only.

3. The process according to claim 2, wherein in the context of said needle-needle selection performed by the knitting machine, the execution of special stitches in certain desired positions only takes place thanks to the needle-sinker interaction, and thanks to the interaction between each needle, which can be individually selected at will, and the respective sinker; each sinker being individually activated by a direct or indirect action of the respective needle when the latter is selected.

4. The process according to claim 1, wherein said portion of terrycloth knitted fabric(S) is strictly manufactured on a first row of said two successive rows, whereas the second row of said two successive rows does not exhibit any portion of terrycloth knitted fabric(S), or vice versa.

5. The process according to claim 1, wherein:

on the first row of said two successive rows a portion of terrycloth knitted fabric(S) is present;

on the second row of said two successive rows a respective portion of terrycloth knitted fabric(S) is present.

6. The process according to claim 1, wherein said programming step includes defining, in said two successive stitch rows:

a portion of terrycloth knitted fabric(S) on the first row of said two successive rows, combined with a portion of plain knitted fabric (L);

plain knitted fabric on the second row of said two successive rows, without any terrycloth knitted fabric.

7. The process according to claim 1, wherein said programming step includes defining, in said two successive stitch rows:

a portion of terrycloth knitted fabric(S) on the first row of said two successive rows, if combined with a portion of plain knitted fabric (L);

knitted fabric made with non-operating needles on the second row of said two successive rows, without any terrycloth knitted fabric.

8. The process according to claim 1, wherein said programming step includes defining, in said two successive stitch rows:

a portion of terrycloth knitted fabric(S) on the first row of said two successive rows;

knitted fabric made with non-operating needles on the second row of said two successive rows and in a position corresponding to the one where terrycloth knitted fabric(S) is present on the first row, or vice versa:

a portion of terrycloth knitted fabric(S) on the second row of said two successive rows;

knitted fabric made with non-operating needles on the first row of said two successive rows and in a position corresponding to the one where terrycloth knitted fabric (S) is present on the second row.

9. The process according to claim 1, wherein said programming step includes defining, in said two successive stitch rows:

a portion of terrycloth knitted fabric(S) and a portion of plain knitted fabric (L), combined on the first row of said two successive rows;

a respective portion of terrycloth knitted fabric(S) and a respective portion of plain knitted fabric (L), combined on the second row of said two successive rows, wherein the portion of terrycloth knitted fabric(S) on the first row and the respective portion of terrycloth knitted fabric(S) on the second row are defined in basically corresponding positions on the development of the fabric.

10. The process according to claim 1, wherein said programming step includes defining, in said two successive stitch rows:

a portion of terrycloth knitted fabric(S) and a portion of plain knitted fabric (L), combined on the first row of said two successive rows;

a respective portion of plain knitted fabric (L) and a respective portion of terrycloth knitted fabric(S), combined on the second row of said two successive rows, wherein the portion of terrycloth knitted fabric(S) on the first row and the respective portion of terrycloth knitted fabric(S) on the second row are defined in inverted positions on the development of the fabric.

11. The process according to claim 1, wherein the first and the second row of the two successive rows are homogeneous with one another and exhibit the same combinations of knitted structures, the first and the second row of the two successive rows exhibit the same knitted structures in suitable positions so as to obtain the motif/pattern to be made.

12. The process according to claim 1, wherein said programming step includes defining simultaneously, within the programmed motif/design, two types of terrycloth knitted fabrics differing from each other or made with two threads having different characteristics, wherein:

a first terrycloth knitted fabric (S1) and a second terrycloth knitted fabric (S2) are made on two distinct stitch rows, according to a configuration with alternating rows;

the motif/design of the fabric exhibits an alternation of first rows with the first terrycloth knitted fabric (S1) and of second rows with the second terrycloth knitted fabric (S2), repeated for a certain number of times;

in said first and second rows the first terrycloth knitted fabric (S1) and the second terrycloth knitted fabric (S2) are placed in given portions so as to make globally a design showing areas with the first terrycloth knitted fabric and areas with the second terrycloth knitted fabric.

13. A textile item manufactured by means a circular weft knitting machine of seamless type, and consisting of a plurality of successive stitch rows; the textile item comprising at least one designed motif, defined on at least two successive stitch rows, following one another, in which a portion of terrycloth knitted fabric(S) is present in at least one of the two successive rows, and wherein said designed motif is defined on a plurality of consecutive rows and consists of a serial repetition, for a certain number of times more than 1, of said two successive stitch rows, so as to obtain a structure with alternating rows, consisting of an alternating sequence of first rows and second rows of said two successive rows.

14. The textile item according to claim 13, wherein said portion of terrycloth knitted fabric(S) is strictly manufactured on a first row of said two successive rows, whereas the second row of said two successive rows does not exhibit any portion of terrycloth knitted fabric(S), or vice versa.

15. The textile item according to claim 13, wherein:

on the first row of said two successive rows a portion of terrycloth knitted fabric(S) is present;

on the second row of said two successive rows a respective portion of terrycloth knitted fabric(S) is present.

16. The textile item according to claim 13, wherein in said two successive stitch rows:

a portion of terrycloth knitted fabric(S) on the first row of said two successive rows, combined with a portion of plain knitted fabric (L);

plain knitted fabric (L) on the second row of said two successive rows, without any terrycloth knitted fabric, are defined.

17. The textile item according to claim 13, wherein said programming step includes defining simultaneously, within the programmed motif/design, two types of terrycloth knitted fabrics differing from each other or made with two threads having different characteristics, wherein:

a first terrycloth knitted fabric (S1) and a second terrycloth knitted fabric (S2) are made on two distinct stitch rows, according to a configuration with alternating rows;

the motif/design of the fabric exhibits an alternation of first rows with the first terrycloth knitted fabric (S1) and of second rows with the second terrycloth knitted fabric (S2), repeated for a certain number of times;

in said first and second rows the first terrycloth knitted fabric (S1) and the second terrycloth knitted fabric (S2) are placed in given portions so as to make globally a design showing areas with the first terrycloth knitted fabric and areas with the second terrycloth knitted fabric.

18. The process according to claim 1, wherein the programming of the knitting machine includes a continuous succession of the same row, where each row exhibits the same types of knitted fabric in corresponding positions.

19. The textile item according to claim 13, wherein in said two successive stitch rows:

a portion of terrycloth knitted fabric(S) on the first row of said two successive rows, combined with a portion of plain knitted fabric (L);

knitted fabric made with non-operating needles on the second row of said two successive rows, without any terrycloth knitted fabric, are defined.

20. The textile item according to claim 17, wherein jacquard knitted fabric or narrowed knitted loops are placed between the portions of the same terrycloth knitted fabric in alternating rows, the jacquard knitted fabric or the narrowing of the knitted loops being present:

for the first terrycloth knitted fabric (S1) in the intermediate rows, associated to the second terrycloth knitted fabric, and in the intermediate portions between two portions of first terrycloth knitted fabric;

for the second terrycloth knitted fabric (S2) in the intermediate rows, associated to the first terrycloth knitted fabric, and in the intermediate portions between two portions of second terrycloth knitted fabric.

* * * * *